US007059357B2

(12) United States Patent
Ward

(10) Patent No.: US 7,059,357 B2
(45) Date of Patent: Jun. 13, 2006

(54) WARP-STITCHED MULTILAYER PAPERMAKER'S FABRICS

(75) Inventor: Kevin John Ward, Nova Scotia (CA)

(73) Assignee: Weavexx Corporation, Wake Forest, NC (US)

( * ) Notice: Subject to any disclaimer, the term of this patent is extended or adjusted under 35 U.S.C. 154(b) by 0 days.

(21) Appl. No.: 10/392,424

(22) Filed: Mar. 19, 2003

(65) Prior Publication Data

US 2004/0182465 A1 Sep. 23, 2004

(51) Int. Cl.
*D21F 1/10* (2006.01)
*D03D 13/00* (2006.01)
*D21F 7/08* (2006.01)

(52) U.S. Cl. ..... 139/348; 139/358.2; 139/900; 139/902; 139/903; 139/383 A; 442/203; 442/205

(58) Field of Classification Search ..... 162/202–207, 162/358.4, 349, 306, 900–904, 116, 117, 162/361; 139/383 A, 425 A; 28/110, 142; 442/203–216
See application file for complete search history.

(56) References Cited

U.S. PATENT DOCUMENTS

| | | | | |
|---|---|---|---|---|
| 2,172,430 | A | 9/1939 | Barrell | 139/383 |
| 2,554,034 | A | 5/1951 | Koester et al. | 139/426 |
| 3,094,149 | A | 6/1963 | Keily | 139/383 |
| 3,325,909 | A | 6/1967 | Clark | 34/95 |
| 4,093,512 | A | 6/1978 | Fleischer | 162/348 |

(Continued)

FOREIGN PATENT DOCUMENTS

| | | | |
|---|---|---|---|
| CA | 1115177 | 12/1981 | 139/58 |

(Continued)

OTHER PUBLICATIONS

Warren, C.A., "The Importance of Yarn Properties in Wet-End Wire Construction," Seminar, The Theory of Water Removal, Dec. 12, 1979.

(Continued)

*Primary Examiner*—Eric Hug
(74) *Attorney, Agent, or Firm*—Myers Bigel Sibley & Sajovec

(57) ABSTRACT

A warp-stitched multilayer papermaker's fabric has a set of bottom warp yarns, a set of bottom weft yarns, a set of top weft yarns and a set of warp stitching yarn pairs. The bottom warp yarns are interwoven with the bottom weft yarns. The stitching warp yarns interweave with both the bottom weft yarns and the top weft yarns, and are woven such that at locations where the first of the stitching warp yarns in a pair weaves in the top fabric layer, the second stitching warp yarn in the pair drops below the top fabric layer to interweave with one or more bottom weft yarns to bind the top fabric layer and the bottom fabric layer together. The first stitching warp yarn of the stitching warp yarn pair may weave on a first side of one of the bottom warp yarns while the second stitching warp yarn of each stitching yarn pair may weave on the other side of that bottom warp yarn. Each stitching yarn pair may be substantially stacked above a bottom warp yarn. The fabric may further include a set of top warp yarns that interweave with the top weft yarns in the top fabric layer. The set of top warp yarns may be woven from a first warp beam, the set of bottom warp yarns may be woven from a second warp beam and the set of stitching warp yarns may be woven from a third warp beam.

51 Claims, 10 Drawing Sheets

U.S. PATENT DOCUMENTS

| | | | | | |
|---|---|---|---|---|---|
| 4,182,381 | A | | 1/1980 | Gisbourne | 139/383 A |
| 4,244,543 | A | | 1/1981 | Ericson | 248/55 |
| 4,289,173 | A | | 9/1981 | Miller | 139/383 A |
| 4,290,209 | A | | 9/1981 | Buchanan et al. | 34/123 |
| 4,414,263 | A | | 11/1983 | Miller et al. | 428/234 |
| 4,438,788 | A | | 3/1984 | Harwood | 139/383 A |
| 4,452,284 | A | | 6/1984 | Eckstein et al. | 139/383 A |
| 4,453,573 | A | | 6/1984 | Thompson | 139/383 A |
| 4,501,303 | A | * | 2/1985 | Osterberg | 139/425 A |
| 4,515,853 | A | | 5/1985 | Borel | 428/257 |
| 4,529,013 | A | | 7/1985 | Miller | 139/383 A |
| 4,554,953 | A | * | 11/1985 | Borel et al. | 139/383 A |
| 4,564,052 | A | | 1/1986 | Borel | 139/425 A |
| 4,592,395 | A | | 6/1986 | Borel | 139/383 A |
| 4,592,396 | A | | 6/1986 | Borel et al. | 139/429 |
| 4,605,585 | A | | 8/1986 | Johansson | 428/224 |
| 4,611,639 | A | | 9/1986 | Bugge | 139/383 A |
| 4,621,663 | A | | 11/1986 | Malmendier | 139/383 A |
| 4,633,596 | A | | 1/1987 | Josef | 34/116 |
| 4,636,426 | A | | 1/1987 | Fleischer | 428/224 |
| 4,642,261 | A | | 2/1987 | Fearnhead | 428/225 |
| 4,676,278 | A | | 6/1987 | Dutt | 139/383 A |
| 4,705,601 | A | | 11/1987 | Chiu | 162/348 |
| 4,709,732 | A | | 12/1987 | Kinnunen | 139/383 A |
| 4,729,412 | A | * | 3/1988 | Bugge | 139/383 A |
| 4,731,281 | A | | 3/1988 | Fleischer et al. | 428/196 |
| 4,739,803 | A | | 4/1988 | Borel | 139/383 A |
| 4,755,420 | A | | 7/1988 | Baker et al. | 428/222 |
| 4,759,975 | A | | 7/1988 | Sutherland et al. | 428/234 |
| 4,815,499 | A | | 3/1989 | Johnson | 139/383 |
| 4,815,503 | A | | 3/1989 | Borel | 139/383 A |
| 4,909,284 | A | | 3/1990 | Kositzke | |
| RE33,195 | E | | 4/1990 | McDonald et al. | 139/425 A |
| 4,934,414 | A | | 6/1990 | Borel | 139/383 A |
| 4,941,514 | A | | 7/1990 | Taipale | 139/383 A |
| 4,942,077 | A | | 7/1990 | Wendt et al. | 428/152 |
| 4,945,952 | A | | 8/1990 | Vöhringer | 139/383 |
| 4,967,805 | A | | 11/1990 | Chiu et al. | 139/383 |
| 4,974,642 | A | * | 12/1990 | Taipale | 139/383 A |
| 4,987,929 | A | | 1/1991 | Wilson | 139/383 A |
| 4,989,647 | A | | 2/1991 | Marchand | 139/383 A |
| 4,989,648 | A | | 2/1991 | Tate et al. | 139/383 |
| 4,998,568 | A | | 3/1991 | Vohringer | 139/383 A |
| 4,998,569 | A | | 3/1991 | Tate | 139/383 A |
| 5,022,441 | A | | 6/1991 | Tate et al. | 139/383 |
| 5,025,839 | A | | 6/1991 | Wright | 139/383 A |
| 5,067,526 | A | | 11/1991 | Herring | 139/383 |
| 5,074,339 | A | | 12/1991 | Vohringer | 139/383 A |
| 5,084,326 | A | | 1/1992 | Vohringer | 428/194 |
| 5,092,372 | A | | 3/1992 | Fitzka et al. | 139/383 A |
| 5,101,866 | A | | 4/1992 | Quigley | 139/383 |
| 5,116,478 | A | | 5/1992 | Tate et al. | 162/358 |
| 5,152,326 | A | | 10/1992 | Vohringer | 139/383 A |
| 5,158,118 | A | | 10/1992 | Tate et al. | 139/383 A |
| 5,219,004 | A | | 6/1993 | Chiu | 139/383 A |
| 5,228,482 | A | | 7/1993 | Fleischer | 139/383 A |
| 5,238,536 | A | * | 8/1993 | Danby | 162/202 |
| 5,277,967 | A | | 1/1994 | Zehle et al. | 428/234 |
| 5,358,014 | A | | 10/1994 | Kovar | 139/383 A |
| 5,421,374 | A | | 6/1995 | Wright | 139/383 A |
| 5,421,375 | A | | 6/1995 | Praetzel | 139/383 A |
| 5,429,686 | A | | 7/1995 | Chiu et al. | 139/383 |
| 5,437,315 | A | | 8/1995 | Ward | 139/383 |
| 5,449,026 | A | | 9/1995 | Lee | 139/383 A |
| 5,454,405 | A | | 10/1995 | Hawes | 139/383 A |
| 5,456,293 | A | | 10/1995 | Ostermayer et al. | 139/383 A |
| 5,465,764 | A | | 11/1995 | Eschmann et al. | 139/383 A |
| 5,482,567 | A | | 1/1996 | Barreto | 139/383 A |
| 5,487,414 | A | | 1/1996 | Kuji et al. | 139/383 |
| 5,518,042 | A | | 5/1996 | Wilson | 139/383 A |
| 5,520,225 | A | | 5/1996 | Quigley et al. | 139/383 A |
| 5,542,455 | A | | 8/1996 | Ostermayer et al. | 139/383 A |
| 5,555,917 | A | | 9/1996 | Quigley | 139/383 A |
| 5,564,475 | A | | 10/1996 | Wright | 139/383 A |
| 5,641,001 | A | | 6/1997 | Wilson | 139/383 A |
| 5,651,394 | A | | 7/1997 | Marchand | 139/383 |
| 5,709,250 | A | | 1/1998 | Ward et al. | 139/383 A |
| 5,713,397 | A | | 2/1998 | Quigley | 139/383 |
| RE35,777 | E | | 4/1998 | Givin | 139/383 A |
| 5,746,257 | A | | 5/1998 | Fry | 139/383 AA |
| 5,826,627 | A | * | 10/1998 | Seabrook et al. | 139/383 A |
| 5,857,498 | A | | 1/1999 | Barreto et al. | 139/383 |
| 5,881,764 | A | | 3/1999 | Ward | 139/383 A |
| 5,894,867 | A | | 4/1999 | Ward et al. | 139/383 |
| 5,899,240 | A | | 5/1999 | Wilson | 139/383 |
| 5,937,914 | A | | 8/1999 | Wilson | 139/383 A |
| 5,967,195 | A | | 10/1999 | Ward | 139/383 |
| 5,983,953 | A | | 11/1999 | Wilson | 139/383 |
| 6,073,661 | A | | 6/2000 | Wilson | 139/383 |
| 6,112,774 | A | | 9/2000 | Wilson | 139/383 |
| 6,123,116 | A | | 9/2000 | Ward et al. | 139/383 |
| 6,145,550 | A | | 11/2000 | Ward | 139/383 |
| 6,148,869 | A | | 11/2000 | Quigley | 139/383 |
| 6,158,478 | A | | 12/2000 | Lee et al. | 139/383 |
| 6,202,705 | B1 | | 3/2001 | Johnson et al. | 139/383 |
| 6,227,255 | B1 | | 5/2001 | Osterberg et al. | |
| 6,244,306 | B1 | | 6/2001 | Troughton | 139/383 |
| 6,253,796 | B1 | | 7/2001 | Wilson et al. | 139/383 |
| 6,354,335 | B1 | * | 3/2002 | Taipale et al. | 139/383 A |
| 6,379,506 | B1 | | 4/2002 | Wilson et al. | 162/348 |
| 2003/0010393 | A1 | * | 1/2003 | Kuji | 139/383 A |
| 2004/0079434 | A1 | | 4/2004 | Martin et al. | |

FOREIGN PATENT DOCUMENTS

| | | | |
|---|---|---|---|
| CN | 2-277848 | | 0/1990 |
| DE | 454 092 | | 12/1927 |
| DE | 3425808 | | 1/1985 |
| DE | 33 29 740 | | 3/1985 |
| EP | 0 048 962 | | 9/1981 |
| EP | 0 158 710 | | 10/1984 |
| EP | 0 185 177 | | 10/1985 |
| EP | 0 224 276 | | 12/1986 |
| EP | 0 264 881 | | 10/1987 |
| EP | 0 269 070 | | 11/1987 |
| EP | 0 284 575 | | 2/1988 |
| EP | 0 283 181 | | 3/1988 |
| EP | 0 350 673 | | 6/1989 |
| EP | 0 408 849 | A2 | 5/1990 |
| EP | 0 408 849 | A3 | 5/1990 |
| EP | 0 672 782 | | 3/1995 |
| EP | 0 794 283 | A1 | 9/1997 |
| EP | 1 273 698 | A2 | 1/2003 |
| FR | 2 597 123 | | 4/1986 |
| FR | 8605115 | | 4/1986 |
| GB | 2157328 | A | 10/1985 |
| GB | 2245006 | | 2/1991 |
| JP | 8-158285 | | 12/1994 |
| JP | 9-41282 | | 7/1995 |
| JP | 9-87990 | | 9/1995 |
| WO | WO 86/00099 | | 1/1986 |
| WO | WO 89/09848 | | 4/1989 |
| WO | WO 93/10304 | | 11/1992 |
| WO | WO 99/61698 | | 5/1999 |
| WO | WO 99/61998 | | 12/1999 |
| WO | WO 02/00996 | | 1/2002 |
| WO | WO 2004/038094 | A1 | 5/2004 |

OTHER PUBLICATIONS

International Search Report for PCT Application No. PCT/US97/18629.

Rule 132 Declaration of Robert G. Wilson (Jun. 26, 1997).

Pictures and related description of prior art fabric, undated, admitted prior art.
Kufferath Geoflex 328 XL 328, undated, admitted prior art.
Copy of International Search Report for PCT/US2004/007784.
Copy of International Search Report for PCT/US2004/007784, dated Dec. 3, 2004.
Copy of International Preliminary Report on Patentability for PCT/US2004/007784, dated May 2, 2005.

* cited by examiner

202

200

204

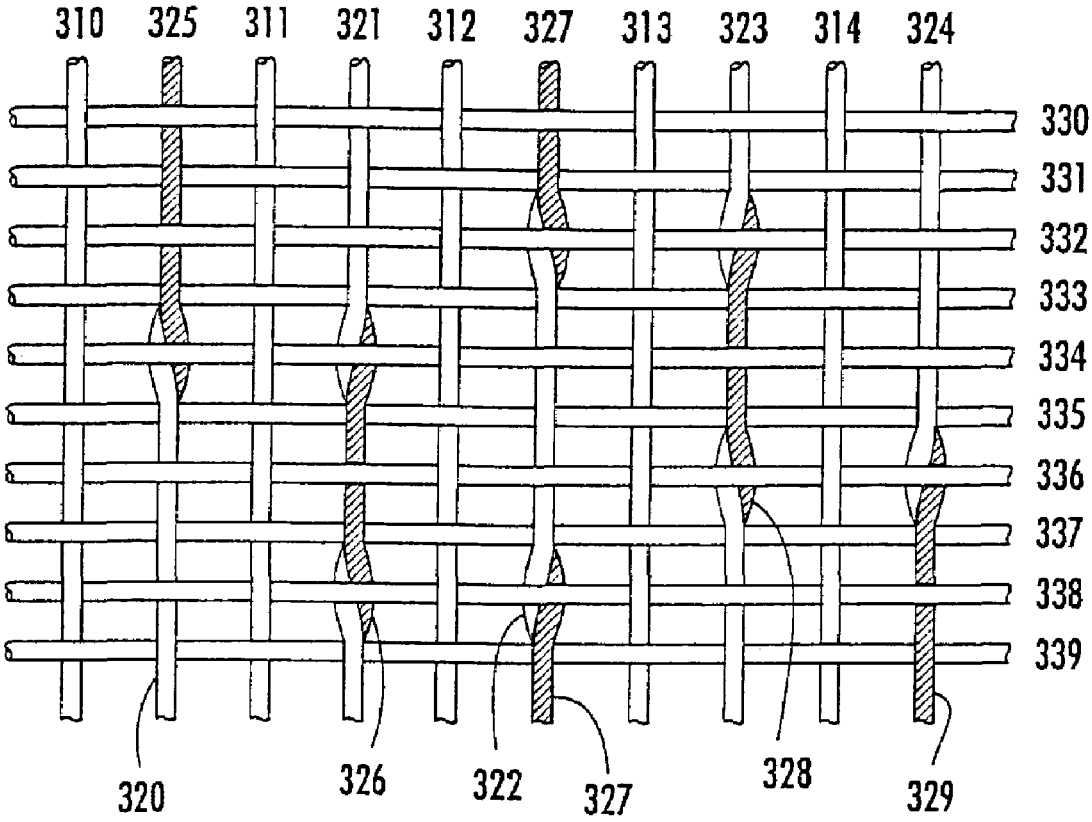
FIGURE 7
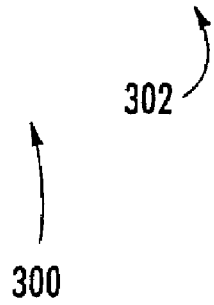

304

310
350
320
351
325
330 331 332 333 334 335 336 337 338 339
360 361 362 363 364 365 366 367 368 369

WARP-STITCHED MULTILAYER PAPERMAKER'S FABRICS

FIELD OF THE INVENTION

The present invention relates generally to papermaking, and relates more specifically to multilayer fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength, stability and life potential. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. No. 5,437,315 to Ward and U.S. Pat. No. 5,967,195 to Ward. Warp-stitched multilayer fabrics are known in the art. Examples of such fabrics are shown in U.S. Pat. No. 5,152,326 to Vohringer, U.S. Pat. No. 6,202,705 B1 to Johnson and PCT Patent No. WO 02/00996 A1.

SUMMARY OF THE INVENTION

The present invention relates to warp-stitched multilayer papermaker's fabrics that employ weave patterns which can provide one or more of the following advantages: good drainage, increased join strength, reduced weaving time, increased weft yarn counts on the papermaking surface (and hence improved fiber support) and increased fabric modulus. The fabrics of the present invention are particularly useful as papermaker's forming fabrics, although the teachings of the present invention may also be advantageous in certain felt and dryer applications.

Certain embodiments of the present invention are directed to warp-stitched triple layer papermaker's fabrics. In one such embodiment, the warp-stitched triple layer fabric has a set of top warp yarns woven from a first warp beam that are interwoven with a set of top weft yarns, and a set of bottom warp yarns woven from a second warp beam that are interwoven with a set of bottom weft yarns. The fabric further includes a set of stitching warp yarns woven from a third warp beam that interweave with at least some of the top weft yarns and with at least some of the bottom weft yarns to bind the top fabric layer and the bottom fabric layer together. The stitching warp yarns may be woven as stitching warp yarn pairs such that at locations in the fabric where the first of the two stitching warp yarns in the pair weaves in the top fabric layer, the second yarn in the pair drops below the top fabric layer so that together the two stitching warp yarns in each pair complete the weave in the top fabric layer.

In another embodiment of the present invention, the warp-stitched fabric is a multilayer papermaker's fabric that has a set of bottom warp yarns, a set of bottom weft yarns, a set of top weft yarns and a set of warp stitching yarn pairs. The bottom warp yarns are interwoven with the bottom weft yarns. The stitching warp yarns interweave with both the bottom weft yarns and the top weft yarns, and are woven such that at locations where the first of the stitching warp yarns in a pair weaves in the top fabric layer, the second stitching warp yarn in the pair drops below the top fabric layer to interweave with one or more bottom weft yarns to bind the top fabric layer and the bottom fabric layer together. In this embodiment, for each stitching warp yarn pair, the first stitching warp yarn of the stitching warp yarn pair may weave on a first side of one of the bottom warp yarns while the second stitching warp yarn of each stitching yarn pair may weave on the other side of that bottom warp yarn. The fabrics of this embodiment may further include a set of top warp yarns that interweave with the top weft yarns in the top fabric layer.

In additional aspects of the present invention, the papermaker's fabric may include stitching yarn pairs that are substantially stacked above a bottom warp yarn. The stitching warp yarns and/or the top warp yarns may have a smaller diameter than the bottom warp yarns. The top weft yarns may have a smaller diameter than the bottom weft yarns. The papermaking surface may be woven in a plain weave pattern. The machine side surface may be woven such that in each repeat unit of the fabric, each stitching warp yarn passes below the same bottom warp yarn as does the bottom warp yarn directly adjacent to it. The stitching warp yarn may also be woven so that it couples with the bottom warp yarn at locations where the yarns pass below the bottom weft yarns so as to form side-by-side machine-side warp direction knuckles. At least some of the top weft yarns that the stitching warp yarns pass over immediately before dropping down below the top fabric layer may have a larger diameter and/or a higher modulus than the remainder of the top weft yarns. Additionally, in embodiments which include pairs of stitching warp yarns, the two yarns in each pair may cross over different numbers of top weft yarns in each repeat of the fabric. The two yarns in each stitching warp yarn pair may also tend to gravitate toward each other.

Additional aspects of the present invention includes methods of manufacturing warp-stitched triple layer fabrics and methods of using the triple layer papermaker's fabric described herein for making paper.

BRIEF DESCRIPTION OF THE FIGURES

FIG. 7 is a top view of the top fabric layer of another embodiment of a 25 harness triple layer forming fabric of the present invention.

DETAILED DESCRIPTION OF THE PREFERRED EMBODIMENTS

Figure 1:
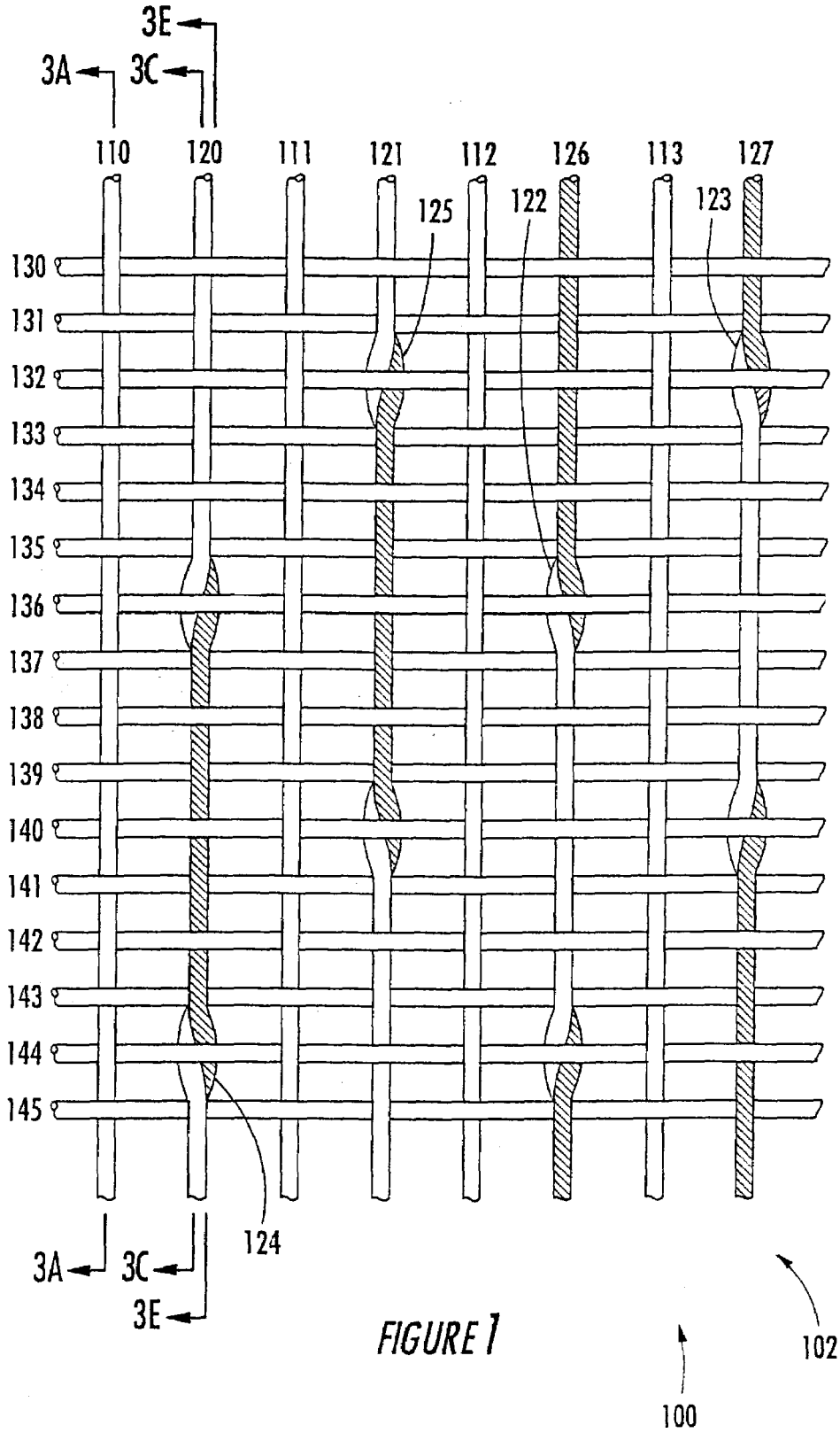
FIG. 1 is a top view of the top fabric layer of an embodiment of a 20 harness triple layer forming fabric of the present invention.

The present invention will now be described more fully hereinafter with reference to the accompanying drawings, in which preferred embodiments of the invention are shown. This invention may, however, be embodied in many different forms and should not be construed as limited to the illustrated embodiments or other embodiments set forth herein; rather, these embodiments are provided so that this disclosure will be thorough and complete, and will fully convey the scope of the invention to those skilled in the art. In the figures, the dimensions of some components may be exaggerated for clarity.

One aspect of the present invention is directed to "true" warp-stitched triple layer papermaker's fabrics in that they include a set of warp yarns and a set of weft yarns that only weave in the top layer of the fabric, as well as a set of warp yarns and a set of weft yarns that only weave in the bottom fabric layer. These fabrics also include stitching warp yarns that weave in both the top fabric layer and the bottom fabric layer to bind the layers together. In certain embodiments of the present invention, the stitching warp yarns are provided as pairs of two stitching yarns that together replace the equivalent of a single warp yarn in the weave pattern on the papermaking surface. These yarns are woven such that when one yarn in the pair is weaving in the top fabric layer so as to complete the weave pattern on the papermaking surface, the second yarn in the pair weaves below the papermaking surface. Throughout the fabric, the yarns in each pair trade these positions. At least one of the yarns in the pair also drops down to the bottom fabric layer at one or more points so as to bind the top and bottom fabric layers together. Herein, these yarn pairs are referred to as "stitching warp yarn pairs."

In certain embodiments of the invention, the "true" warp-stitched triple layer papermaker's fabrics are woven from three separate warp beams. As will be appreciated by those of skill in the art, in manufacturing papermaker's fabrics using a flat weaving process, the warp yarns are fed into the loom off of one or more warp yarn beams (or "warp beams") and the weft yarns or "picks" are "thrown" one-by-one by the loom so that they pass in the desired over/under pattern with respect to the warp yarns to weave the fabric. The tension on the yarns in each warp beam may be independently controlled, and the types of yarns provided on each beam (e.g., yarn size, modulus, filament type, etc.) may be varied. By weaving the warp-stitched fabrics of the present invention off of three separate warp beams, at least two distinct advantages may accrue.

First, by using three separate warp beams, it is possible to vary the size and/or type of yarn used for (1) the top warp yarns, (2) the bottom warp yarns and (3) the stitching warp yarns. This may be advantageous because the requirements for yarns that weave in the top layer versus the bottom layer versus both layers may differ. By way of example, in many applications, it may be desirable to use larger, sturdier warp yarns in the bottom fabric layer to provide good stretch resistance and stability. In contrast, finely woven warp yarns are often preferred on the papermaking surface as such yarns may facilitate providing a highly uniform surface that exhibits good drainage while providing a high degree of fiber support. The stitching warp yarns may have their own unique requirements. Through the use of three separate warp beams, the fabric designer can optimize the type and sizes of yarns used for the yarns that weave in different parts of the fabric. Second, the use of a separate warp beam for the top, bottom and stitching warp yarns also allows for independent tension control on each type of warp yarn. This tension control may also be used to increase the uniformity of the papermaking surface as variations in tension may impact the degree of the crimp that each type of yarn exhibits on the papermaking surface.

Pursuant to another aspect of the present invention, multilayer warp-stitched papermaker's fabrics are provided which include stitching warp yarn pairs that are substantially stacked above a bottom warp yarn. This aspect of the present invention is best explained with reference to FIGS. 10A–10C, which are cross-sectional views of a portion of a representative fabric that show the configuration of the warp yarns in the fabric.

Figure 10A:
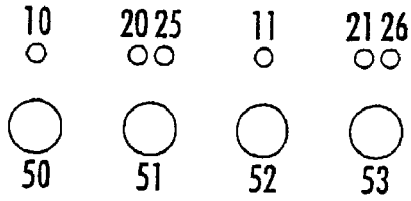
FIGS. 10A–C are cross-sectional views of selected warp yarns in a fabric constructed according to one aspect of the present invention.

As shown in FIG. 10A, the illustrative fabric sample includes four bottom warp yarns 50–53 that weave exclusively in a bottom fabric layer. The fabric further includes two top warp yarns 10–11 that weave exclusively in a top fabric layer. Four stitching warp yarns 20, 21, 25, 26 are further provided that weave in both the top fabric layer and the bottom fabric layer. In the view of FIG. 10A, all of the stitching warp yarns are weaving adjacent the top fabric layer. As illustrated in the figure, the stitching warp yarns are provided as stitching warp yarn pairs 20, 25 and 21, 26. As shown in FIG. 10A, stitching warp yarn pair 20, 25 is substantially stacked over a bottom warp yarn 51, and stitching warp yarn pair 22, 26 is substantially stacked over a bottom warp yarn 53.

Figure 10B:
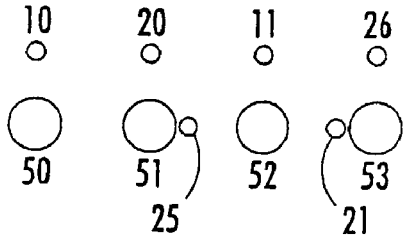
Figure 10C:
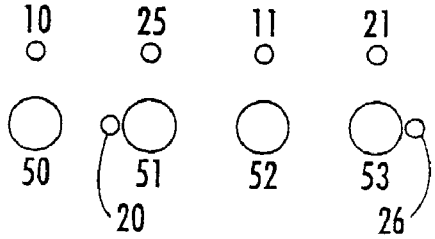

FIG. 10B is another cross-sectional view of the same fabric shown in FIG. 10A. In FIG. 10B, two of the stitching warp yarns 25, 21 are weaving in the bottom fabric layer while the yarns that they are paired with (yarns 20 and 26) are weaving in the top fabric layer. FIG. 10C is a third cross-sectional view of the same fabric. In FIG. 10C, the yarns in each stitching yarn pair 20, 25; 21, 26 have traded positions so that yarns 25, 21 are weaving in the top fabric layer and yarns 20, 26 are weaving in the bottom fabric layer.

As discussed above, each of the stitching warp yarn pairs 20, 25; 21, 26 are "substantially stacked" over a bottom warp yarn (yarns 51 and 53). By "substantially stacked" it is meant that the stitching warp yarns that comprise each pair, at least in locations where they weave in the papermaking surface, are generally located above a bottom warp yarn as opposed to being located in the open area falling between two adjacent bottom warp yarns. By weaving the fabric to include such stacked stitching yarn pairs it may be possible to improve the straight-through drainage of the fabric. It will be understood, however, that the stitching warp yarns that comprise the stitching warp yarn pair will not be stacked over the bottom warp yarn at all locations. This can best be seen in FIGS. 10B and 10C, which show that at (and about) locations where the stitching warp yarns interlace with the bottom weft yarns the stitching warp yarns will weave alongside the bottom warp yarns as opposed to being stacked over them.

Pursuant to another aspect of the present invention, the fabric may include stitching warp yarn pairs which are woven so that the two yarns in each such pair interlace with the bottom weft yarns on opposite sides of a bottom warp yarn. This feature of the present invention is illustrated, for example, in FIGS. 10B and 10C. As shown in FIG. 10B, when weaving in the bottom fabric layer, stitching warp yarn 25 weaves on the right side of bottom warp yarn 51. However, as shown in FIG. 10C, the stitching warp yarn 20 that is paired with stitching warp yarn 25 weaves on the left side of bottom warp yarn 51 when weaving in the bottom fabric layer. Such a configuration may help facilitate stacking the stitching warp yarn pairs above a bottom warp yarn to improve straight-through drainage. Such a configuration may also facilitate coupling the stitching warp yarns with the bottom warp yarn—which is often a larger, sturdier yarn—at locations where both yarns form a machine side warp direction knuckle. As discussed below, such coupling of the yarns may help protect the potentially smaller stitching warp yarn from wear.

Figure 2:
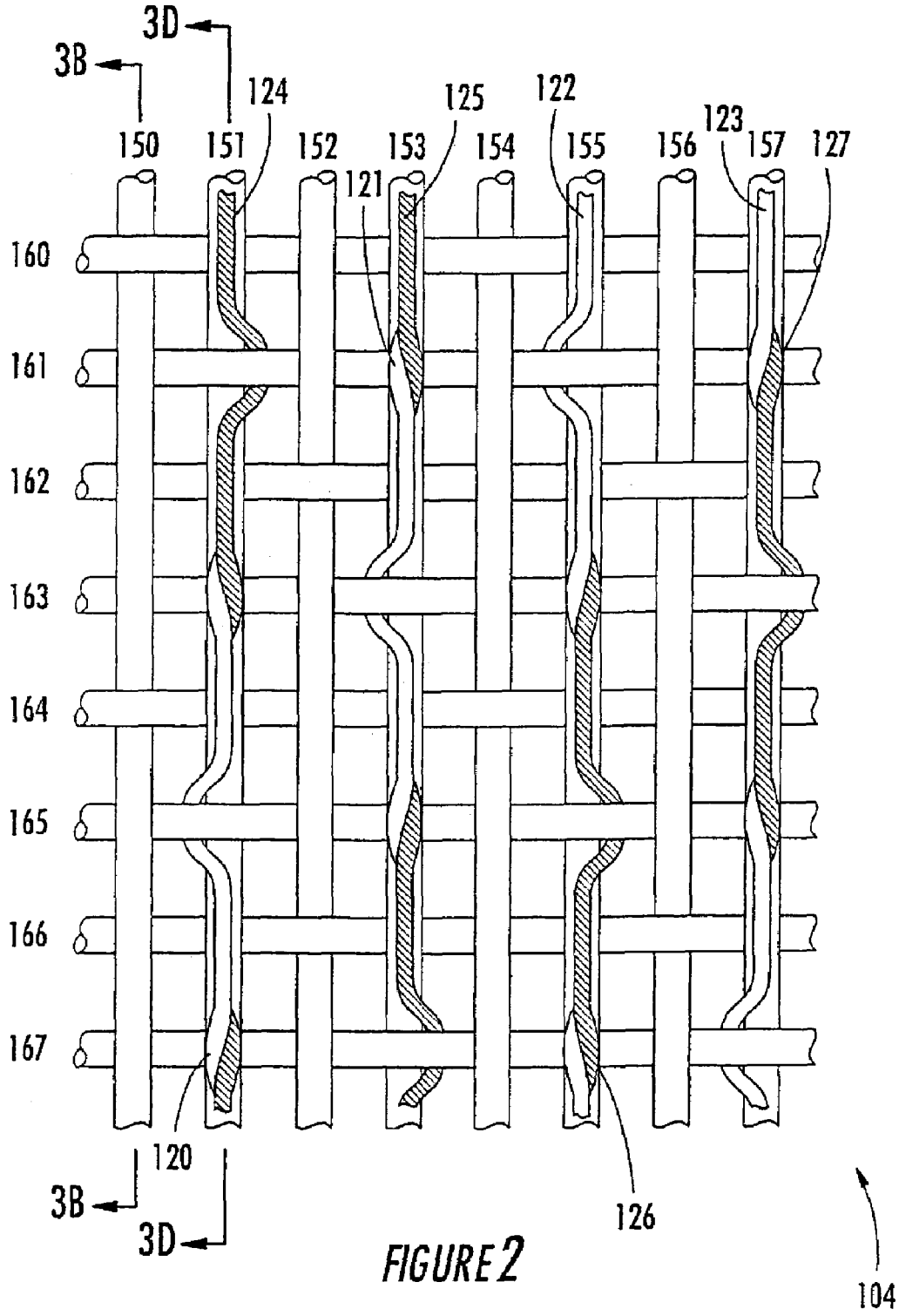
FIG. 2 is a top view of the bottom fabric layer of the triple layer forming fabric of FIG. 1.

An embodiment of the warp-stitched triple layer fabrics of the present invention is illustrated in FIGS. 1–3 and designated broadly at 100. FIG. 1 depicts a top view of the top fabric layer 102 of the triple layer fabric 100 (i.e., a view of the papermaking surface) while FIG. 2 depicts a top view of the bottom fabric layer 104 of fabric 100 (i.e., a view of the fabric 100 with the top fabric layer 102 removed). FIGS. 3A–3E depict the paths of the warp yarns 110, 150, 120, 151, 124 that are depicted in FIGS. 1–2. The triple layer fabric 100 of FIGS. 1–3 is woven on 20 harnesses. As shown in FIGS. 1–3, a single repeat of the fabric encompasses 20 warp yarns (yarns 110–113, 120–127, 150–157) and 24 weft yarns (yarns 130–145, 160–167). While FIGS. 1 and 2 only show a single repeat unit of the fabric, those of skill in the art will appreciate that in commercial applications the repeat unit shown in FIGS. 1 and 2 would be repeated many times, in both the warp and weft directions, to form a large fabric suitable for use on a papermaking machine.

As seen in FIG. 1, the repeat unit of the top fabric layer 102 includes a set of top layer warp yarns 110–113 and a set of top layer weft yarns 130–145 that are interwoven together. The top fabric layer 102 further includes a set of four stitching warp yarn pairs 120, 124; 121, 125; 122, 126; 123, 127 that also interweave with the top weft yarns 130–145. As shown in FIG. 1, a stitching warp yarn pair, such as for example, stitching warp yarn pair 120, 124, is provided between each pair of adjacent top warp yarns, such as yarns 110–111. Each stitching warp yarn pair (such as pair 120, 124) is woven such that while one of the yarns of the pair (e.g., yarn 120) weaves in the top fabric layer 102 to "complete the weave" pattern in the top fabric layer 102, the other of the stitching warp yarns (e.g., yarn 124) drops down into the bottom fabric layer 104 to bind the top fabric layer 102 and the bottom fabric layer 104 together. In this manner, the stitching warp yarn pairs 120, 124; 121, 125; 122, 126; 123, 127 both complete the weave of the top layer fabric 102 and also serve to bind the top and bottom fabric layers 102, 104 together.

As shown in FIG. 1, the yarns comprising the set of top layer weft yarns 130–145 are interwoven with the set of top layer warp yarns 110–113 and the stitching warp yarn pairs 120, 124; 121, 125; 122, 126; 123, 127 (each pair of which weaves on the papermaking surface as the equivalent of a single yarn) in a 1×1 or "plain weave" pattern, meaning that each of the top layer weft yarns 130–145 alternately pass below one, and then above the next, of the warp yarns that at that point are weaving in the papermaking surface. For example, top weft yarn 130 passes below top warp yarn 110, above stitching warp yarn 120, below top warp yarn 111, above stitching warp yarn 121, below top warp yarn 112, above stitching warp yarn 126, below top warp yarn 113, and above stitching warp yarn 127. The other top weft yarns 131–145 follow an identical "over one/under one" pattern, although this pattern is offset by one warp yarn for adjacent top layer weft yarns 130–145.

Referring now to FIG. 2, a repeat unit of the top surface of the bottom fabric layer 104 of the fabric 100 is shown. The repeat unit includes a set of bottom warp yarns 150–157 which are interwoven with a set of bottom weft yarns 160–167. The repeat unit further includes the stitching warp yarn pairs 120, 124; 121, 125; 122, 126; 123, 127 which are described above. As shown in FIG. 2, the stitching warp yarn pairs 120, 124; 121, 125; 122, 126; 123, 127 are substantially stacked over bottom warp yarns 151, 153, 155, 157, respectively. However, in the vicinity of the locations where one of the stitching warp yarns (e.g., yarn 120) interlaces with a bottom weft yarn (e.g., yarn 165) the stitching warp yarn 120 bends so that the yarn 120 interlaces with the bottom weft yarn 165 adjacent the bottom warp yarn 151 that the stitching warp yarn 120 otherwise resides above. In this manner, a side-by-side warp direction knuckle is formed by the bottom warp yarn 151 and the stitching warp yarn 120 on the machine side surface of the fabric.

As shown in FIG. 2, the bottom weft yarns 160–167 may be constructed using relatively large diameter yarns that are well suited to sustain the wear caused by the friction between the machine side surface of the fabric 100 and the papermaking machine during use of the fabric 100. As can also be seen in FIG. 2, the weave pattern of fabric 100 provides relatively long weft "floats" on the machine side surface, meaning that, from the viewpoint of FIG. 2, the weft yarns pass or "float" below large numbers of adjacent warp yarns so that the larger, sturdier bottom weft yarns 160–167, as opposed to the warp yarns 150–157, 120–127, primarily come into contact with the papermaking machine. The bottom warp yarns 150–157 may also be constructed using larger diameter yarns than the yarns used for the stitching warp yarns 120–127 and the top warp yarns 110–113.

As noted above, in the fabric depicted in FIGS. 1 and 2, the top fabric layer 102 (pictured in FIG. 1) and the bottom fabric layer 104 (pictured in FIG. 2) are bound together by the stitching warp yarn pairs 120, 124; 121, 125; 122, 126; 123, 127. In FIG. 1, only those portions of the stitching warp yarns 120–127 which weave with the top fabric layer 102 are depicted. In FIG. 2, only those portions of the stitching warp yarns 120–127 which weave with the bottom fabric layer 104 are depicted.

Figure 3A:
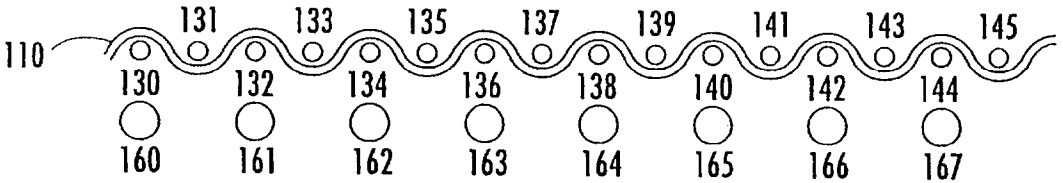
FIGS. 3A–3E are section views taken along the lines 3A—3A through 3E—3E of FIG. 1.

FIGS. 3A–3E depict the warp yarn paths (for one repeat of the fabric) of warp yarns 110, 150, 120, 151, 124, respectively, of fabric 100. As shown in FIG. 3A the top warp yarn 110 is woven in an "over-one/under-one" pattern with the top weft yarns 130–145. The top warp yarn 110 does not interlace any of the bottom warp yarns 160–167. Top warp yarns 111–113 are woven in the exact same pattern with respect to the top weft yarns 130–145 as top warp yarn 110, and top warp yarns 111–113 likewise do not weave in the bottom fabric layer.

Figure 3B:
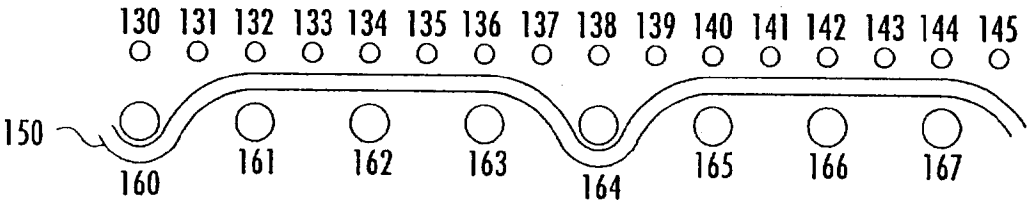

As shown in FIG. 3B, the bottom warp yarn 150 is woven with the bottom weft yarns 160–167 in an "over-three/under-one/over-three/under-one" pattern. Specifically, bottom warp yarn 150 passes under bottom weft yarn 160, over bottom weft yarns 161–163, under bottom weft yarn 164, and over bottom weft yarns 165–167 in each repeat unit of the fabric. Bottom warp yarn 154 follows an identical pattern as warp yarn 150, and bottom warp yarns 152, 156 follow a similar "over-three/under-one/over-three/under-one pattern" weave pattern, although this pattern is offset by two bottom layer weft yarns 160–167 as compared to the pattern followed by bottom warp yarns 150 and 154.

Figure 3C:
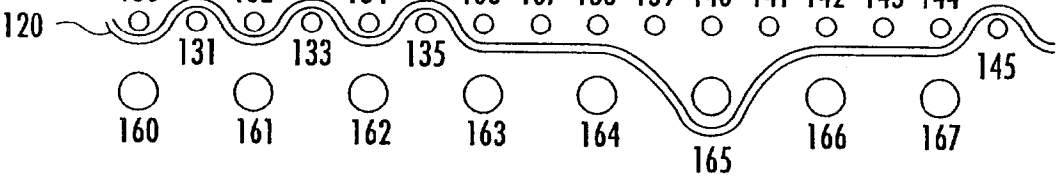

FIG. 3C depicts the path for stitching warp yarn 120. As shown in FIG. 3C, stitching warp yarn 120 weaves with the top weft yarns 130–145 in an "under-one/over-one/under-one/over-one/under-one/over-one/under-nine/over-one" pattern and with the bottom weft yarns 160–167 in an "over-seven/under-one" pattern. Stitching warp yarns 121–123 are woven in the same pattern with the top weft yarns 130–145 and the bottom weft yarns 160–167 as is stitching warp yarn 120, except that each stitching warp yarn 120–123 is offset by two bottom weft yarns (and hence four top weft yarns) with respect to the stitching warp yarns 120–123 adjacent to it.

Figure 3D:
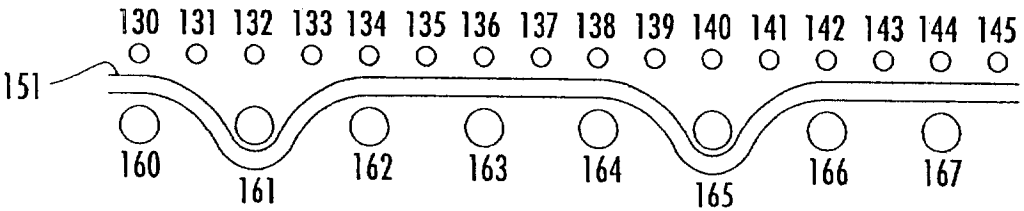

As shown in FIG. 3D, the bottom warp yarn 151 is woven with the bottom weft yarns 160–167 in an "over-three/under-one/over-three/under-one" pattern. Specifically, bottom warp yarn 151 passes over bottom weft yarn 160, under bottom weft yarn 161, over under bottom weft yarns 162–164, under bottom weft yarn 165 and over bottom weft yarns 166–167 in each repeat unit of the fabric. Bottom warp yarn 155 follows an identical pattern as warp yarn 151, and bottom warp yarns 153, 157 follow a similar "over-three/under-one/over-three/under-one pattern" weave pattern, although this pattern is offset by two bottom layer weft yarns 160–167 as compared to the pattern followed by bottom warp yarns 151 and 155.

Figure 3E:
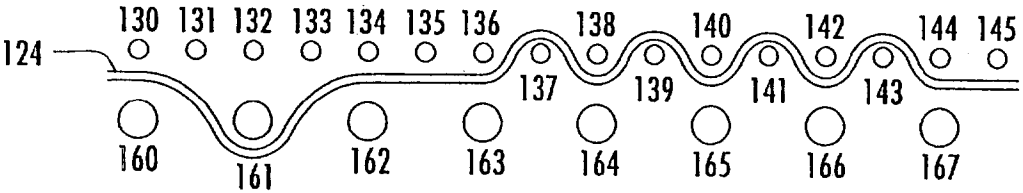

FIG. 3E depicts the path for stitching warp yarn 124. As shown in FIG. 3E, stitching warp yarn 124 weaves with the top weft yarns 130–145 in an "under-nine/over-one/under-one/over-one/under-one/over-one/under-one/over-one" pattern and with the bottom weft yarns 160–167 in an "over-seven/under-one" pattern. Stitching warp yarns 125–127 are woven in the same pattern with the top weft yarns 130–145 and the bottom weft yarns 160–167 as is stitching warp yarn 124, except that each stitching warp yarn 124–127 is offset by two bottom weft yarns (and hence four top weft yarns) with respect to the stitching warp yarns 124–127 adjacent to it.

In the embodiment of the present invention depicted in FIGS. 1–3, only 40% of the warp yarns (i.e., 8 out of the 20 warp yarns in each repeat of the fabric) weave in both the top fabric layer 102 and the bottom fabric layer 104. As a result of this configuration, improved "stacking" of the yarns running in the warp direction may be obtained as compared to fabrics such as the fabrics depicted in WO 02/00996 A1 (in which all of the warp yarns stitch with both the top and bottom fabric layers). The stacked warp yarn arrangement of fabric 100 can provide straight-through drainage—a desired fabric feature in many papermaking applications—as water reaching the top surface of the top fabric layer 102 meets relatively large drainage holes between the yarns that go straight through to the bottom of the bottom fabric layer 104. Additionally, by having less than 100% of the warp yarns weaving in both the top and bottom fabric layers 102, 104, it is generally possible to reduce the yarn mass within the fabric, thereby providing a fabric having increased permeability and a higher void volume than an equivalent fabric formed with 100% of the warp yarns configured as stitching yarns. These features are also desirable in numerous papermaking applications.

As can also be seen in FIG. 2, one of the bottom warp yarns 150–157 comes together with or "couples" with each of the stitching warp yarns 120–127 at locations where the stitching warp yarns pass below a bottom weft yarn so as to form a knuckle on the machine side surface. Thus, for example, bottom warp yarn 151 couples with stitching warp yarn 120 in the vicinity of bottom weft yarn 165, and couples with stitching warp yarn 124 in the vicinity of bottom weft yarn 161. Often, when two adjacent yarns "couple" in this manner persons of skill in the art refer to the two yarns as "pairing" at the locations where the yarns come together in the weave. However, to avoid confusion given the references to "stitching warp yarn pairs" herein, the word "couples" will be used to describe situations where two yarns come together within the weave.

The coupling arrangement that occurs between the bottom warp yarns 151, 153, 155, 157 and the stitching warp yarns 120–127 may have several beneficial effects in certain fabrics. First, in many fabrics the bottom warp yarns 150–157 will be woven using larger, sturdier yarns than the yarns used for the top warp yarns 110–113 or the stitching warp yarns 120–127, since smaller diameter yarns are usually selected for yarns that weave on the papermaking surface. Thus, by having the stitching warp yarns 120–127 couple with a bottom warp yarn 151, 153, 155, 157 at locations where the stitching warp yarns 120–127 form a knuckle on the machine side surface, the stitching warp yarns are partially protected from wear by the larger bottom warp yarns that they couple with. This may advantageously extend the life of the fabric, as a potential failure point for a multilayer fabric is wear of the stitching yarns that come in contact with the papermaking machine. Additionally, having two warp yarns coupled at the locations where the warp yarns pass below the bottom weft yarns to form a knuckle on the machine side surface potentially acts to increase the upward force on the bottom weft yarn at that location. This increased upward force helps to "bury" the warp yarn knuckle on the machine side surface up into the bottom fabric layer 104, which further may help to reduce the machine-induced wear on the bottom warp yarns 151, 153, 155, 157 and the stitching warp yarns 120–127.

Figure 4:
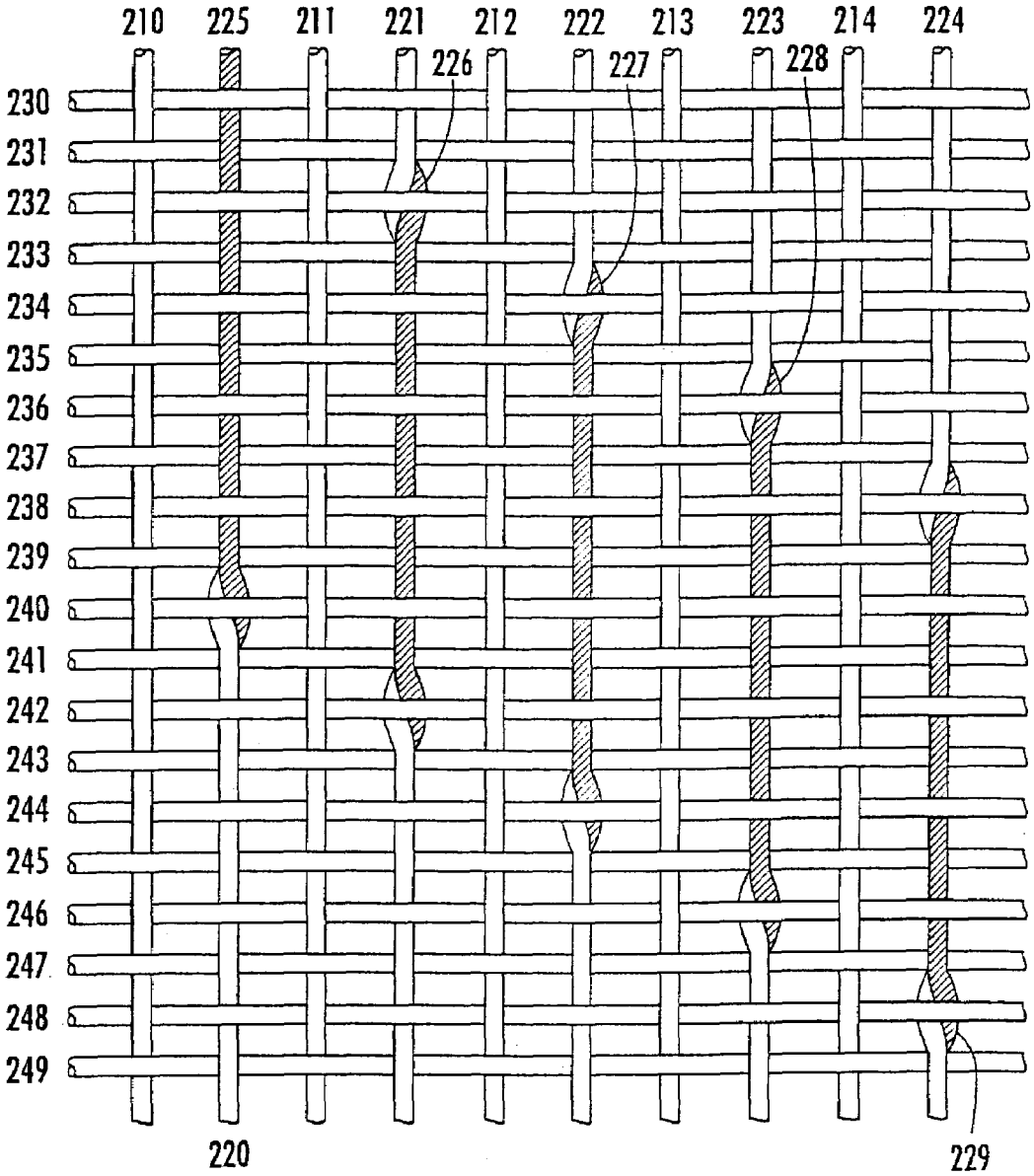
FIG. 4 is a top view of the top fabric layer of an embodiment of a 25 harness triple layer forming fabric of the present invention.
Figure 5:
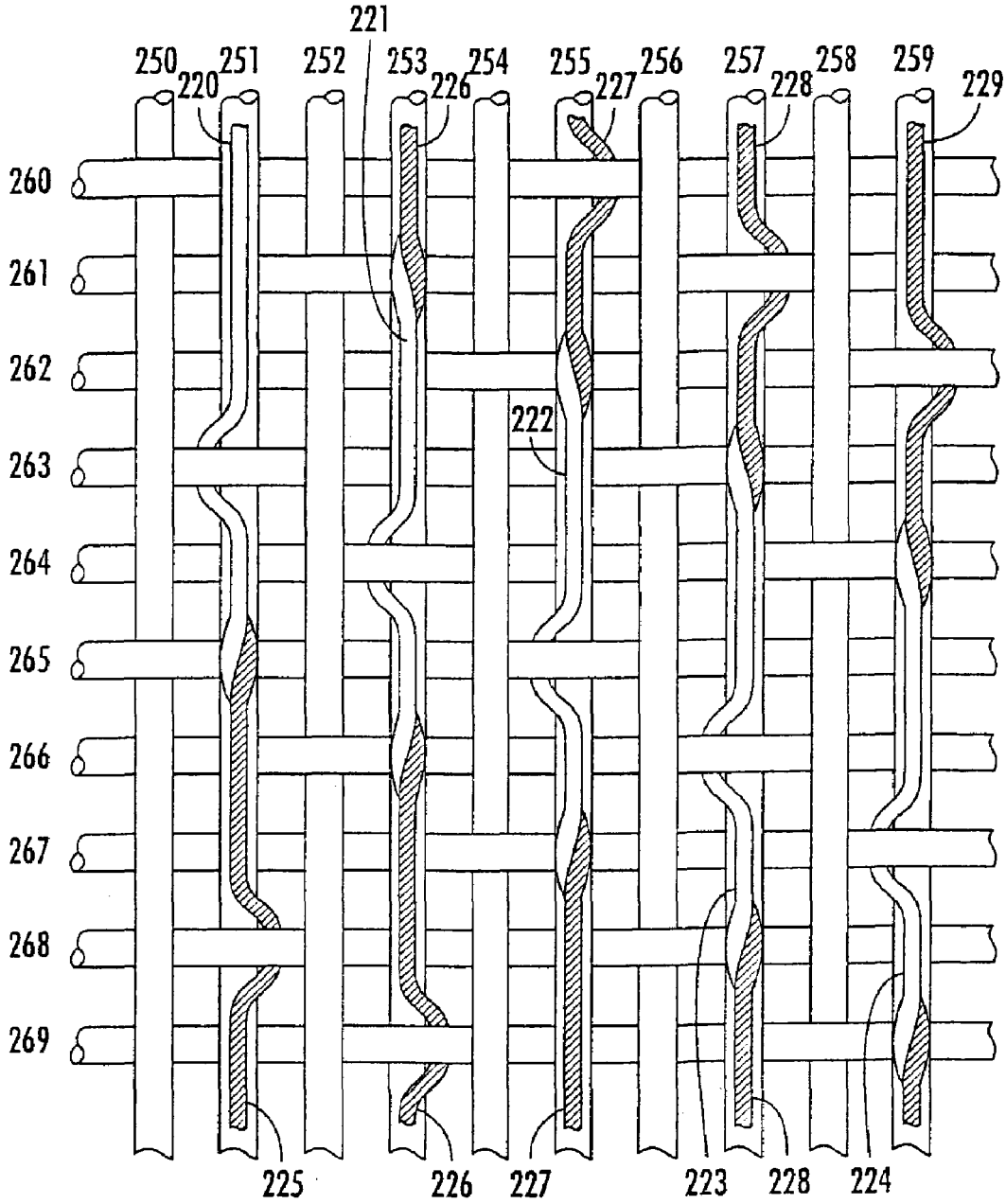
FIG. 5 is a top view of the bottom fabric layer of the triple layer forming fabric of FIG. 4.
Figures 6A, 6B, 6C, 6D, 6E:
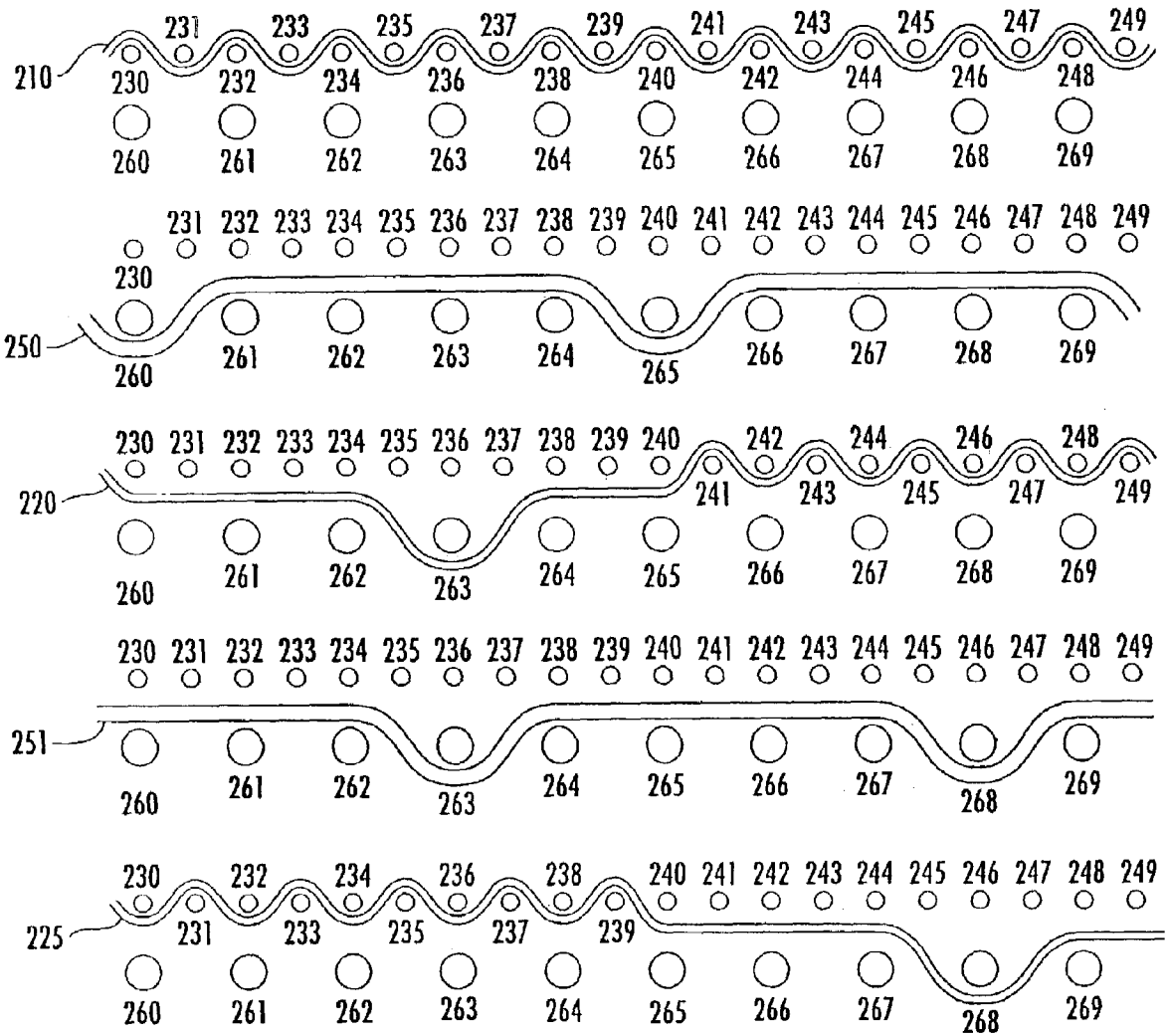
FIGS. 6A–6E are section views taken along the lines 6A—6A through 6E—6E of FIG. 4.

Another fabric 200 constructed according to the teachings of the present invention is illustrated in FIGS. 4–6. FIG. 4 depicts a top view of the top fabric layer 202 of the triple layer fabric 200 (i.e., a view of the papermaking surface) while FIG. 5 depicts a top view of the bottom fabric layer 204 of fabric 200 (i.e., a view of the fabric 200 with the top fabric layer 202 removed). FIGS. 6A–6E depict the paths of the warp yarns 210, 250, 220, 251, 225 that are depicted in FIGS. 4–5. The triple layer fabric 200 of FIGS. 4–6 is woven on 25 harnesses. As shown in FIGS. 4–6, a single repeat of the fabric encompasses 25 warp yarns (yarns 210–214, 220–229, 250–259) and 30 weft yarns (yarns 230–249, 260–269). While FIGS. 4 and 5 only show a single repeat unit of the fabric, those of skill in the art will appreciate that in commercial applications the repeat unit shown in FIGS. 4 and 5 would be repeated many times, in both the warp and weft directions, to form a large fabric suitable for use on a papermaking machine.

As seen in FIG. 4, the repeat unit of the top fabric layer 202 includes a set of top layer warp yarns 210–214 and a set of top layer weft yarns 230–249 that are interwoven together. The top fabric layer further includes a set of stitching warp yarn pairs 220, 225; 221, 226; 222, 227; 223, 228, 224, 229 that also interweave with the top weft yarns 230–249. As shown in FIG. 4, a stitching warp yarn pair, such as for example, stitching warp yarn pair 220, 225, is provided between each pair of adjacent top warp yarns, such as yarns 210–211. Each stitching warp yarn pair (such as pair 220, 225) is woven such that while one of the yarns of the pair (e.g., yarn 220) weaves in the top fabric layer 202 to complete the weave pattern in the top fabric layer 202, the other of the stitching warp yarns (e.g., yarn 224) drops down into the bottom fabric layer 204 to bind the top fabric layer 202 and the bottom fabric layer 204 together. In this manner, the stitching warp yarn pairs 220, 225; 221, 226; 222, 227; 223, 228, 224, 229 both complete the weave of the top layer fabric 202 and also serve to bind the top and bottom fabric layers 202, 204 together.

As shown in FIG. 4, the yarns comprising the set of top layer weft yarns 230–249 are interwoven with the set of top layer warp yarns 210–214 and the stitching warp yarn pairs 220, 225; 221, 226; 222, 227; 223, 228, 224, 229 in a plain weave pattern on the papermaking surface. Thus, for example, top weft yarn 230 passes below top warp yarn 210, above stitching warp yarn 225, below top warp yarn 211, above stitching warp yarn 221, below top warp yarn 212, above stitching warp yarn 222, below top warp yarn 213, above stitching warp yarn 223, below top warp yarn 214 and above stitching warp yarn 225. The other top weft yarns 231–249 follow an identical "over one/under one" pattern, although this pattern is offset by one warp yarn for adjacent top layer weft yarns 230–249.

Referring now to FIG. 5, a repeat unit of the top surface of the bottom fabric layer 204 of the fabric 200 is shown. The repeat unit includes a set of bottom warp yarns 250–259 which are interwoven with a set of bottom weft yarns 260–269. The repeat unit further includes the stitching warp yarn pairs 220, 225; 221, 226; 222, 227; 223, 228, 224, 229 which are described above. As shown in FIG. 5, the stitching warp yarn pairs 220, 225; 221, 226; 222, 227; 223, 228, 224, 229 are substantially stacked over bottom warp yarns 251, 253, 255, 257, 259, respectively. However, in the vicinity of the locations where one of the stitching warp yarns (e.g., yarn 220) interlaces with a bottom weft yarn (e.g., yarn 263) the stitching warp yarn 220 bends so that the yarn 220 interlaces with the bottom weft yarn 263 adjacent the bottom warp yarn 251 that the stitching warp yarn 220 otherwise runs above. In this manner, a side-by-side warp direction knuckle is formed by the bottom warp yarn 251 and the stitching warp yarn 220 on the machine side surface of the fabric.

As shown best in FIG. 5, the bottom weft yarns 260–267 may be constructed using relatively large diameter yarns that are well suited to sustain the wear caused by the friction between the machine side surface of the fabric 200 and the papermaking machine during use of the fabric 200. As can be seen in FIG. 5, the weave pattern of fabric 200 provides relatively long weft "floats" on the machine side surface.

As noted above, in the fabric depicted in FIGS. 4 and 5, the top fabric layer 202 (pictured in FIG. 2) and the bottom fabric layer 204 (pictured in FIG. 5) are bound together by the stitching warp yarn pairs 220, 225; 221, 226; 222, 227; 223, 228, 224, 229. In FIG. 4, only those portions of the stitching warp yarns 220–229 which weave with the top fabric layer 202 are depicted. In FIG. 5, only those portions of the stitching warp yarns 220–229 which weave with the bottom fabric layer 204 are depicted.

FIGS. 6A–6E depict the paths (for one repeat of the fabric) of warp yarns 210, 250, 220, 251, 224, respectively, of fabric 200. As shown in FIG. 6A the top warp yarn 210 is woven in an "over-one/under-one" pattern with the top weft yarns 230–249. The top warp yarn 210 does not weave with the bottom fabric layer 204. Top warp yarns 211–214 are woven in the exact same pattern with respect to the top weft yarns 230–249 as top warp yarn 210, and top warp yarns 211-214 likewise do not weave in the bottom fabric layer.

As shown in FIG. 6B, the bottom warp yarn 250 is woven with the bottom weft yarns 260–267 in an "over-four/under-one/over-four/under-one" pattern. Specifically, bottom warp yarn 250 passes under bottom weft yarn 260, over bottom weft yarns 261–264, under bottom weft yarn 265, and over bottom weft yarns 266–269 in each repeat unit of the fabric. Bottom warp yarns 252, 254, 256, 258 follow an identical "over-four/under-one/over-four/under-one" pattern, although this pattern is offset by one bottom weft yarn 260–269 for adjacent bottom warp yarns 250, 252, 254, 256, 258.

FIG. 6C depicts the warp yarn path for stitching warp yarn 220. As shown in FIG. 6C, stitching warp yarn 220 weaves with the top weft yarns 230–249 in an "under-eleven/over-one/under-one/over-one/under-one/over-one/under-one/over-one/under-one/over-one" pattern and with the bottom weft yarns 260–269 in an "over-nine/under-one" pattern. Stitching warp yarns 221–224 are woven in the same pattern with the top weft yarns 230–249 and the bottom weft yarns 260–269 as is stitching warp yarn 220, except that each stitching warp yarn 220–224 is offset by one bottom weft yarn (and hence two top weft yarns) with respect to the stitching warp yarns 220–224 adjacent to it.

As shown in FIG. 6D, the bottom warp yarn 251 is woven with the bottom weft yarns 260–269 in an "over-four/under-one/over-four/under-one" pattern. Specifically, bottom warp yarn 251 passes over bottom weft yarns 260–262, under bottom weft yarn 263, over under bottom weft yarns 264–267, under bottom weft yarn 268 and over bottom weft yarn 269. Bottom warp yarns 253, 255, 257, 259 follow an identical "over-four/under-one/over-four/under-one" pattern, although this pattern is offset by one bottom weft yarn 260–269 for adjacent bottom warp yarns 251, 253, 255, 257, 259.

FIG. 6E depicts the warp yarn path for stitching warp yarn 225. As shown in FIG. 6E, stitching warp yarn 225 weaves with the top weft yarns 230–249 in an "under-one/over-one/under-one/over-one/under-one/over-one/under-one/over-one/under-one/over-one/under-ten" pattern and with the bottom weft yarns 260–269 in an "over-nine/under-one" pattern. Stitching warp yarns 226–229 are woven in the same pattern with the top weft yarns 230–249 and the bottom weft yarns 260–269 as is stitching warp yarn 225, except that each stitching warp yarn 225–229 is offset by one bottom weft yarns (and hence two top weft yarns) with respect to the stitching warp yarns 225–229 adjacent to it.

Figure 8:
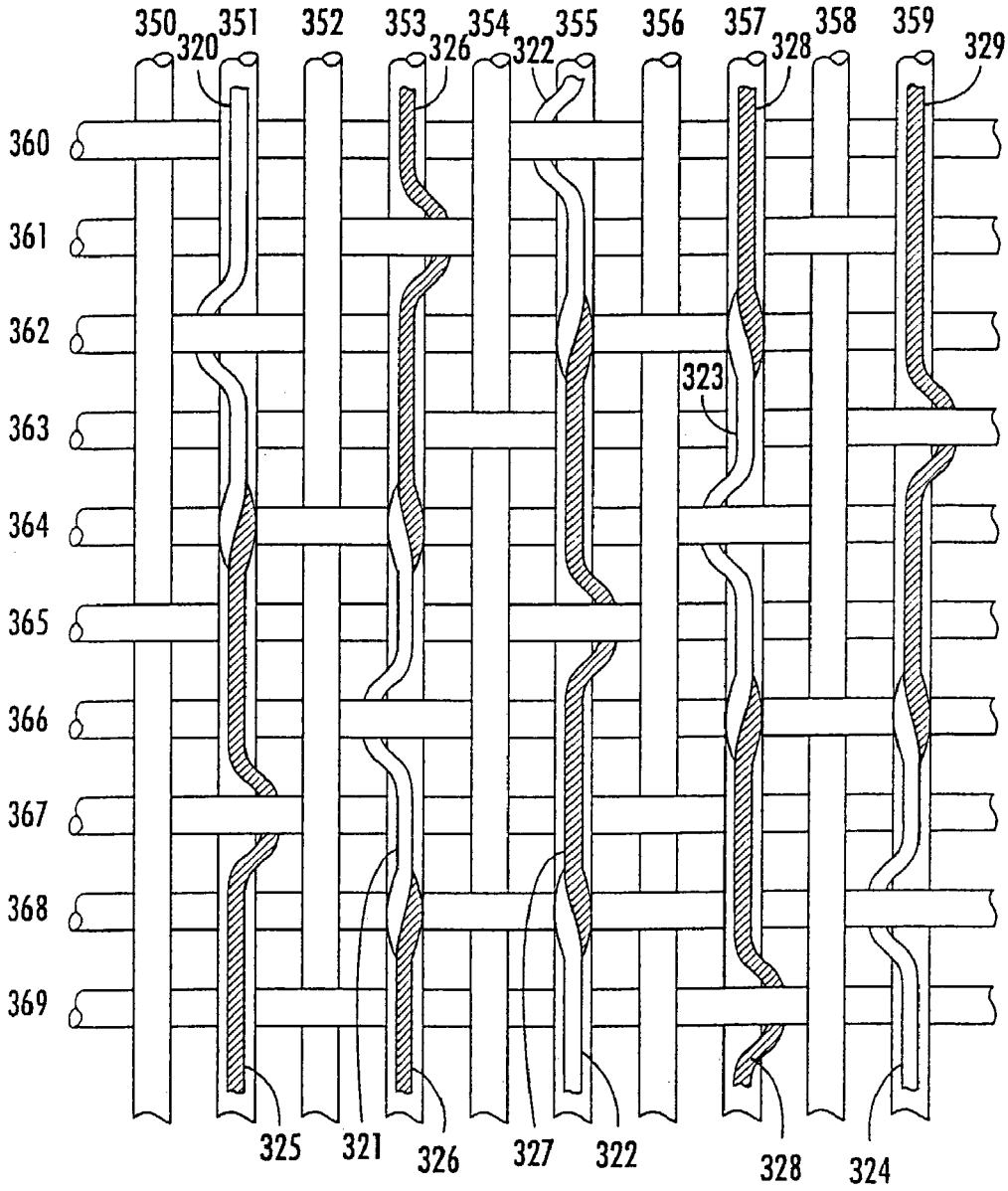
FIG. 8 is a top view of the bottom fabric layer of the triple layer forming fabric of FIG. 7.
Figures 9A, 9B, 9C, 9D, 9E:
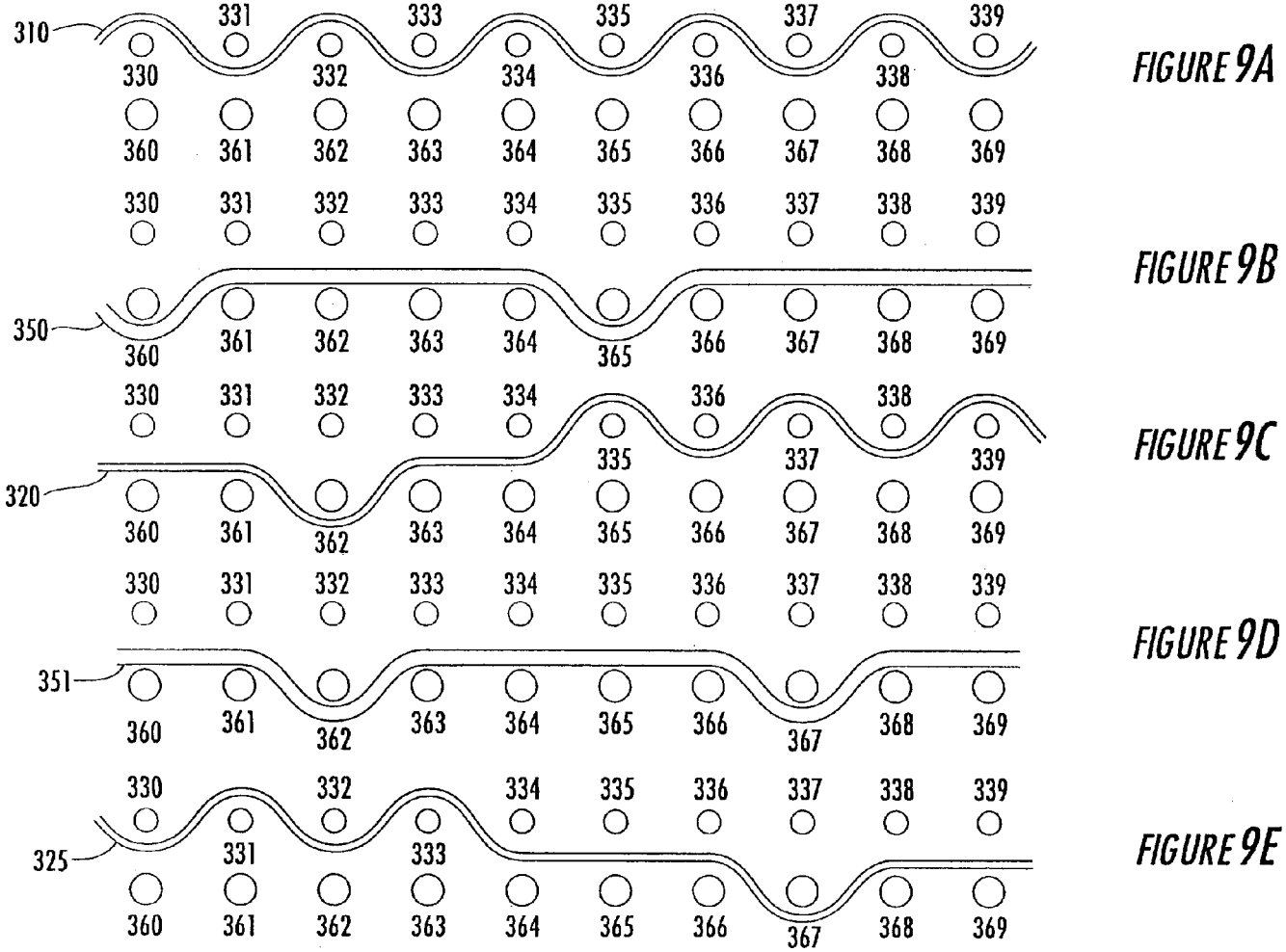
FIGS. 9A–9E are section views taken along the lines 9A—9A through 9E—9E of FIG. 7.

Another fabric 300 constructed according to the teachings of the present invention is illustrated in FIGS. 7–9. FIG. 7 depicts a top view of the top fabric layer 302 of the triple layer fabric 300 (i.e., a view of the papermaking surface) while FIG. 8 depicts a top view of the bottom fabric layer 304 of fabric 300 (i.e., a view of the fabric 300 with the top fabric layer 302 removed). FIGS. 9A–9E depict the paths of the warp yarns 310, 350, 320, 351, 325 that are depicted in FIGS. 7–8. The triple layer fabric 300 of FIGS. 7–9 is woven on 25 harnesses and has a one-to-one "pick" ratio between top weft yarns and bottom weft yarns (as opposed to the two-to-one pick ratio in the fabrics 100 and 200 described above). As shown in FIGS. 7–9, a single repeat of the fabric encompasses 25 warp yarns (yarns 310–314, 320–329, 350–359) and 20 weft yarns (yarns 360–369). While FIGS. 7 and 8 only show a single repeat unit of the fabric, those of skill in the art will appreciate that in commercial applications the repeat unit shown in FIGS. 7 and 8 would be repeated many times, in both the warp and weft directions, to form a large fabric suitable for use on a papermaking machine.

As seen in FIG. 7, the repeat unit of the top fabric layer 302 includes a set of top layer warp yarns 310–314 and a set of top layer weft yarns 330–339 that are interwoven together. The top fabric layer further includes a set of stitching warp yarn pairs 320, 325; 321, 326; 322, 327; 323, 328, 324, 329 that also interweave with the top weft yarns 330–339. As shown in FIG. 7, a stitching warp yarn pair, such as for example, stitching warp yarn pair 320, 325, is provided between each pair of adjacent top warp yarns, such as yarns 310–311. Each stitching warp yarn pair (such as pair 320, 325) is woven such that while one of the yarns of the pair (e.g., yarn 320) weaves in the top fabric layer 302 to complete the weave pattern in the top fabric layer 302, the other of the stitching warp yarns (e.g., yarn 325) drops down into the bottom fabric layer 304 to bind the top fabric layer 302 and the bottom fabric layer 304 together. In this manner, the stitching warp yarn pairs 320, 325; 321, 326; 322, 327; 323, 328, 324, 329 both complete the weave of the top layer fabric 302 and also serve to bind the top and bottom fabric layers 302, 304 together.

As shown in FIG. 7, the yarns comprising the set of top weft yarns 330–339 are interwoven with the set of top layer warp yarns 310–314 and the stitching warp yarn pairs 320, 325; 321, 326; 322, 327; 323, 328, 324, 329 in a plain weave pattern on the papermaking surface. Thus, for example, top weft yarn 330 passes below top warp yarn 310, above stitching warp yarn 325, below top warp yarn 311, above stitching warp yarn 321, below top warp yarn 312, above stitching warp yarn 327, below top warp yarn 313, above stitching warp yarn 323, below top warp yarn 314 and above stitching warp yarn 324. The other top weft yarns 331–339 follow an identical "over one/under one" pattern, although this pattern is offset by one warp yarn for adjacent top layer weft yarns 330–339.

Referring now to FIG. 8, a repeat unit of the top surface of the bottom fabric layer 304 of the fabric 300 is shown. The repeat unit includes a set of bottom warp yarns 350–359 which are interwoven with a set of bottom weft yarns 360–369. The repeat unit further includes the stitching warp yarn pairs 320, 325; 321, 326; 322, 327; 323, 328, 324, 329 which are described above. As shown in FIG. 8, the stitching warp yarn pairs 320, 325; 321, 326; 322, 327; 323, 328, 324, 329 are substantially stacked over bottom warp yarns 351, 353, 355, 357, 359, respectively. However, in the vicinity of the locations where one of the stitching warp yarns (e.g., yarn 320) interlaces with a bottom weft yarn (e.g., yarn 362), the stitching warp yarn 320 bends so that the yarn 320 interlaces with the bottom weft yarn 362 adjacent the bottom warp yarn 351 that the stitching warp yarn 320 otherwise runs above. In this manner, a side-by-side warp direction knuckle is formed by the bottom warp yarn 351 and the stitching warp yarn 320 on the machine side surface of the fabric. As is also shown in FIG. 8, the bottom weft yarns 360–369 may be constructed using relatively large diameter yarns that are well suited to sustain the wear caused by the friction between the machine side surface of the fabric 300 and the papermaking machine during use of the fabric 300.

As noted above, in the fabric depicted in FIGS. 7 and 8, the top fabric layer 302 and the bottom fabric layer 304 are bound together by the stitching warp yarn pairs 320, 325; 321, 326; 322, 327; 323, 328, 324, 329. In FIG. 7, only those portions of the stitching warp yarns 320–329 which weave with the top fabric layer 302 are depicted. In FIG. 8, only those portions of the stitching warp yarns 320–329 which weave with the bottom fabric layer 304 are depicted.

FIGS. 9A–9E depict the warp yarn paths (for one repeat of the fabric) of warp yarns 310, 350, 320, 351, 325, respectively, of fabric 300. As shown in FIG. 9A the top warp yarn 310 is woven in an "over-one/under-one" pattern with the top weft yarns 330–339. The top warp yarn 310 does not weave with the bottom fabric layer 304. Top warp yarns 311–314 are woven in the exact same pattern with respect to the top weft yarns 330–339 as top warp yarn 310, and top warp yarns 311–314 likewise do not weave in the bottom fabric layer 304.

As shown in FIG. 9B, the bottom warp yarn 350 is woven with the bottom weft yarns 360–367 in an "over-four/under-one/over-four/under-one" pattern. Bottom warp yarns 352, 354, 356, 358 follow an identical "over-four/under-one/over-four/under-one" pattern, although this pattern is offset by one bottom weft yarn 360–369 for adjacent bottom warp yarns 350, 352, 354, 356, 358.

FIG. 9C depicts the warp yarn path for stitching warp yarn 320. As shown in FIG. 9C, stitching warp yarn 320 weaves with the top weft yarns 330–339 in an "under-five/over-one/under-one/over-one/under-one/over-one" pattern and with the bottom weft yarns 360–369 in an over-nine/under-one pattern. Stitching warp yarns 321–324 are woven in the same pattern with the top weft yarns 330–339 and the bottom weft yarns 360–369 as is stitching warp yarn 320, except that each stitching warp yarn 320–324 is offset by four bottom weft yarns (and hence four top weft yarns) with respect to the stitching warp yarns 320–324 adjacent to it.

As shown in FIG. 9D, the bottom warp yarn 351 is woven with the bottom weft yarns 360–369 in an "over-four/under-one/over-four/under-one" pattern. Bottom warp yarns 353, 355, 357, 359 follow an identical "over-four/under-one/over-four/under-one" pattern, although this pattern is offset by one bottom weft yarn 360–369 for adjacent bottom warp yarns 351, 353, 355, 357, 359.

FIG. 9E depicts the warp yarn path for stitching warp yarn 325. As shown in FIG. 9E, stitching warp yarn 325 weaves with the top weft yarns 330–339 in an "under-one/over-one/under-one/over-one/under-six" pattern and with the bottom weft yarns 360–369 in an "over-nine/under-one" pattern. Stitching warp yarns 326–329 are woven in the same pattern with the top weft yarns 330–339 and the bottom weft yarns 360–369 as is stitching warp yarn 325, except that each stitching warp yarn 325–329 is offset by four bottom weft yarns (and hence four top weft yarns) with respect to the stitching warp yarns 325–329 adjacent to it.

The principles of the present invention can be extended to a variety of different types of fabrics. For instance, the principles may be employed in fabrics woven on different numbers of harnesses, as shown by the exemplary 20 and 25 harness embodiment fabrics that are pictured and described above. The principles may also be employed with fabrics having various top to bottom weft yarn ratios. Various of the principles may also be employed on any multilayer fabrics, and not just the "true" triple layer fabrics depicted in FIGS. 1–9.

As noted above, certain embodiments of the present invention are directed to "true" triple layer fabrics—meaning triple layer fabrics that include (1) a set of warp yarns and a set of weft yarns that each weave exclusively in a top fabric layer, (2) a set of warp yarns and a set of weft yarns that each weave exclusively in a bottom fabric layer and (3) stitching warp yarns that stitch the top and bottom fabric layers together. Pursuant to the teachings of the present invention, it will be appreciated that the warp-stitched true triple layer fabrics may have improved stacking, increased permeability and higher fiber support as compared to double layer fabrics. Additionally, by using stitching warp yarn pairs that complete the weave in the papermaking surface, it is possible to bind the fabric together at numerous locations, thereby providing a very stable fabric that is resistant to interlayer wear.

Pursuant to another aspect of the present invention, the yarns comprising each stitching warp yarn pair may interlace with the top fabric layer an unequal number of times in each repeat of the fabric. For example, as shown best in FIGS. 9C and 9E, stitching warp yarn 320 of fabric 300 interlaces with the top fabric layer 302 three time per repeat while stitching warp yarn 325 with which yarn 320 is paired only interlaces with the top fabric layer 302 two times per repeat unit of the fabric. This "unequal interlacing" configuration may provide improved performance in certain applications.

Pursuant to another aspect of the present invention, the stitching warp yarns in each stitching warp yarn pair may be woven so that they tend to gravitate toward each other in the weave. This may be accomplished by having the weft yarns exert forces on each stitching warp yarn that urge the stitching warp yarn in the direction of the other yarn in each stitching warp yarn pair. These forces may facilitate substantially stacking the stitching warp yarns above a bottom warp yarn (except near the points where the stitching warp yarns interlace with the bottom weft yarns) so as to provide for improved straight-through drainage in the fabric.

As noted above, in certain embodiments of the present invention, the warp yarns are woven from three separate warp beams and at least two different sizes of warp yarns may be used. This may provide several potential benefits. For example, in many conventional weft-stitched triple layer fabrics, the weft stitching yarns contribute very little to the strength of the join of the fabric (i.e., where the two ends of a flat woven fabric are connected to form the endless belt) as compared to the top weft yarns and the bottom weft yarns. In warp-stitched fabrics such as the fabrics of the present invention, no weft stitching yarns are provided so that all of the weft yarns contribute more significantly to the strength of the join. Thus, the fabrics of the present invention may have improved join strength as compared to more conventional triple layer fabrics. Additionally, the fabrics of the present invention may exhibit increased fabric modulus (i.e., the fabric is less prone to stretching and elongation). This feature results from the fact that warp-stitched multilayer fabrics that include paired stitching warp yarn pairs tend to have a higher warp yarn count as compared to conventional weft-stitched multilayer fabrics. The fabrics of the present invention also will tend to have reduced weaving time (as the stitching yarn pairs are implemented as warp yarns, thus reducing the number of required weft yarns). Additionally, implementing the stitching yarn pairs as warp yarns helps to reduce the crowding of yarns in the fabric in the weft direction, thus allowing for a higher weft yarn count on the papermaking surface per inch, which can improve the level of fiber support provided.

Those of skill in the art will appreciate that numerous modifications can be made to the above described fabrics. By way of example, the yarns that form each stitching warp yarn pair can be woven in a wide variety of different weave patterns to complete any given weave pattern in the top fabric layer. Thus, for example, in the fabric depicted in FIGS. 1–3, the stitching warp yarn pairs are woven so that both yarns in each pair interlace with the top weft yarns four times per repeat to complete the plain weave pattern on the papermaking surface. Instead, these yarns could be woven so that (1) one yarn of each pair interlaced five times and the other yarn interlaced three times, (2) one yarn of each pair interlaced six times and the other yarn interlaced two times or (3) one yarn of each pair interlaced seven times and the other yarn interlaced one time per repeat. Additionally, the frequency with which the yarns pass in and out of the top fabric layer may also be varied, and the pattern for each stitching warp yarn pair need not be the same. In fact, some stitches may not necessarily interlace with the bottom weft yarns. Additionally, a variety of different weave patterns may be employed in the top fabric layer, specifically including 1×2 twill, 2×2 twill, 1×3 and 1×4 twill papermaking surfaces, as well as various derivatives of the above-mentioned weave patterns including broken twill patterns such as those embodied in 4 or 5 harness satin single layer fabrics, which are known in the art as providing a good papermaking surface. Likewise, the frequency of the stitch points and/or the ratio of top-to-bottom warp and/or weft yarns may be varied. Thus, the scope of the present invention should be construed based on the claims appended hereto, as opposed to the illustrative examples of the claimed fabrics which are provided herein to fully enable those of skill in the art to practice the claimed invention.

Those of skill in the art will likewise appreciate that the stitching warp yarn pairs need not be included between every adjacent pair of top warp yarns. Instead, a stitching warp yarn pair may be provided after every second, third, fourth or fifth top warp yarn. Additionally, the top warp yarns themselves could be replaced by stitching warp yarn pairs in certain embodiments of the present invention. Those of skill in the art will also appreciate that the frequency of interlacing can be varied from that shown in the fabrics pictured herein. However, the stitching warp yarns should sufficiently bind the upper and lower fabric layers together to prevent excessive movement between the fabric layers, as such excessive movement could result in inter-layer wear problems.

Yet another modification is to vary the positions of the stitching warp yarns that form each stitching warp yarn pair. For instance, the fabric 100 depicted in FIGS. 1–3 could be modified so that stitching yarn 120 was woven to fall on the right side of bottom warp yarn 151 as those yarns are depicted in FIG. 2, and stitching warp yarn 124 could be woven to fall on the left side of bottom warp yarn 151. Similar switching of the stitching warp yarn positions could be done with some or all of the other stitching warp yarn pairs.

Pursuant to another aspect of the present invention, the size and or stiffness of selected of the top weft yarns may be varied to improve fabric performance. As illustrated best in FIG. 1, the papermaking surface of certain fabrics made according to the present invention include "transition points" where one of the stitching warp yarns in a stitching warp yarn pair completes its run on the papermaking surface and passes down into the center of the fabric while the second yarn of the stitching warp yarn pair emerges from the center of the fabric to start its run on the papermaking surface. An example of such a transition point is the point where stitching warp yarns 120 and 124 pass under top weft yarn 136 in FIG. 1. At these transition points the yarns of the stitching warp yarn pair enter or exit the fabric at a steeper angle as the yarns pass down to, or emerge from, a portion of their run where they weave with the bottom fabric layer 104. This steeper angle may decrease the crimp on the stitching warp yarns at the position where they pass over the last top weft yarn adjacent to the transition point—i.e., where stitching warp yarn 120 passes over top weft yarn 135 and where stitching warp yarn 124 passes over top weft yarn 137—as the stitching warp yarn exerts sufficient force on the top weft yarn to pull the top weft yarn slightly farther into the middle of the fabric at this point. Pursuant to the teachings of the present invention, it will be understood that this reduction in the crimp of the stitching warp yarn knuckles adjacent the transition points can be reduced or eliminated by using slightly larger diameter top weft yarns for the top weft yarns that bracket each transition point. In the fabric of FIG. 1, this would mean making top weft yarns 131, 133, 135, 137, 139, 141, 143, 145 slightly larger than the other top weft yarns. For example, if the top weft yarns 130, 132, 134, 136, 138, 140, 142, 144 are 0.11 millimeters in diameter, then top weft yarns 131, 133, 135, 137, 139, 141, 143, 145 may be made 0.13 millimeters in diameter. Instead of modifying the diameter of top weft yarns, one may alternatively use stiffer yarns (i. e., yarns having a higher elastic modulus, such as an elastic modulus that is 25 to 50% higher) that will more effectively resist the tendency to be pulled into the fabric adjacent the transition points.

The use of larger diameter and/or higher modulus top weft yarns may also improve the uniformity of the papermaking surface at the transition points themselves. If such yarns are not used, the papermaking surface knuckle formed by the top weft yarn directly over the transition point may be lower than the remainder of the knuckles formed by the top weft yarns because the stitching warp yarns at that location pass down at a steeper angle and hence provide less support to the top weft yarn. By using larger diameter or higher modulus yarns on the top weft yarn positions that straddle the transition point it is possible to raise the height of the top weft yarn that passes over the transition point at the transition point location.

Notably, in the bottom fabric layers 104, 204, 304 of fabrics 100, 200, 300, respectively, the set of bottom warp yarns and the set of bottom weft yarns form a machine-side surface having only "single float" warp knuckles. By a "single float" machine-side warp knuckle it is meant that when the bottom fabric layer is viewed from the top, no warp yarn passes under more than one consecutive weft yarn (such that the warp yarn is on the machine-side surface) before passing back to the top surface of the bottom fabric layer. In a preferred embodiment of the triple layer forming fabrics of the present invention, the bottom fabric layer is woven so as to have a machine side surface composed primarily or exclusively of machine side "single float" warp knuckles.

The fabrics pictured and otherwise described and claimed herein may be employed in a variety of applications, including fine paper grades, tissue paper, brown paper and newsprint, but is especially beneficial for fine paper, newsprint and brown paper applications.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface. In a typical embodiment of the triple layer fabrics disclosed herein, preferably the diameter of the top weft yarns, the top warp yarns and the stitching warp yarns is between about 0.10 and 0.22 mm, the diameter of the bottom warp yarns is between about 0.14 and 0.27 mm, and the diameter of the bottom weft yarns is between about 0.18 and 0.50 mm. Those of skill in the art will appreciate that yarns having diameters outside the above ranges may be used in certain applications. In one embodiment of the present invention, the top weft yarns, the top warp yarns and the stitching warp yarns have diameters of about 0.13 mm, and the diameter of the bottom warp yarns is about 0.17 mm. In this embodiment the diameter of the bottom weft yarns is between about 0.33 and 0.36 mm. The total top finished end count on this fabric is 34 ends per centimeter. Fabrics employing these yarn sizes may be implemented with polyester yarns or with a combination of polyester and nylon yarns.

The fabrics of the present invention have been described herein are flat woven fabrics and hence the warp yarns for these fabrics run in the machine direction (a direction aligned with the direction of travel of the papermakers' fabric on the papermaking machine) when the fabric is used on a papermaking machine and the weft yarns for these fabrics run in the cross machine direction (a direction parallel to the fabric surface and traverse to the direction of travel) when the fabric is used on a papermaking machine. However, those of skill in the art will appreciate that the fabrics of the present invention could also be woven using an endless weaving process. If such endless weaving were used, the warp yarns would run in the cross machine direction and the weft yarns would run in the machine direction when the fabric was used on a papermaking machine.

Pursuant to another aspect of the present invention, methods of making triple layer papermaker's fabrics are provided. Pursuant to these methods, the fabrics are woven using three separate warp beams. Warp yarns that weave exclusively in the top fabric layer are provided off of the first warp beam. Warp yarns that weave exclusively in the bottom fabric layer are woven off of the second warp beam. Warp yarns that weave in both the top and bottom fabric layers are woven off of the third beam. The warp yarns on the second beam preferably have a larger diameter than the warp yarns woven off the first beam. Additionally, the warp yarns woven off the third beam may differ from the warp yarns woven off both the first and second warp beams, e.g., they might have a lower modulus of elasticity.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention will not be provided herein.

The foregoing embodiments are illustrative of the present invention, and are not to be construed as limiting thereof. The invention is defined by the following claims, with equivalents of the claims to be included therein.

That which is claimed:

1. A warp-stitched triple layer papermaker's fabric having a top fabric layer that has a papermaking surface and a bottom fabric layer that has a machine side surface comprising:

a set of top warp yarns woven from a first warp beam that weave exclusively in the top fabric layer;

a set of top weft yarns interwoven with the top warp yarns;

a set of bottom warp yarns woven from a second warp beam that weave exclusively in the bottom fabric layer;

a set of bottom weft yarns interwoven with the bottom warp yarns;

a set of stitching warp yarns woven from a third warp beam that interweave with at least some of the top weft yarns and with at least some of the bottom weft yarns to bind the top fabric layer and the bottom fabric layer together;

wherein the stitching warp yarns are woven as stitching warp yarn pairs such that at locations in the fabric where the first of the two stitching warp yarns in the stitching warp yarn pair weaves in the top fabric layer, the second of the two stitching warp yarns in the stitching warp yarn pair drops below the top fabric layer so that together the two stitching warp yarns in each stitching warp yarn pair complete the weave in the top fabric layer; and wherein, in each repeat of the fabric, each stitching warp yarn and a respective one of the bottom warp yarns that is directly adjacent to said stitching warp yarn pass below the same bottom weft yarn.

2. The papermaker's fabric of claim 1, wherein the yarns comprising the set of top warp yarns have a smaller diameter than the yarns comprising the set of bottom warp yarns.

3. The papermaker's fabric of claim 2, wherein the yarns comprising the set of stitching warp yarns differ from the yarns comprising the set of top warp yarns in at least one of the following characteristics: size, modulus or polymer type.

4. The papermaker's fabric of claim 1, wherein at least some of the top weft yarns that the stitching warp yarns of the stitching warp yarn pairs pass over immediately before dropping down below the top fabric layer have a larger diameter than the remainder of the top weft yarns.

5. The papermaker's fabric of claim 1, wherein at least some of the top weft yarns that the stitching warp yarns of the stitching warp yarn pairs pass over immediately before dropping down below the top fabric layer have a higher modulus than the remainder of the top weft yarns.

6. The papermaker's fabric of claim 1, wherein all of the yarns in the set of top warp yarns weave over the same top weft yarns.

7. The papermaker's fabric of claim 6, wherein the top weft yarns that the top warp yarns pass over have a smaller diameter than the remainder of the top weft yarns.

8. The papermaker's fabric of claim 6, wherein the top weft yarns that the top warp yarns pass over have a lower elastic modulus than the remainder of the top weft yarns.

9. The papermaker's fabric of claim 1, wherein the two stitching warp yarns in each pair of stitching warp yarns cross over different numbers of top weft yarns in each repeat of the fabric.

10. The papermaker's fabric of claim 1, wherein the stitching warp yarns in each stitching warp yarn pair tend to gravitate toward each other.

11. The papermaker's fabric of claim 3, wherein the yarns comprising the set of top weft yarns have a smaller diameter than the yarns comprising the bottom set of weft yarns.

12. The papermaker's fabric of claim 1, wherein the papermaker's fabric is a forming fabric.

13. The papermaker's fabric of claim 1, wherein a stitching warp yarn pair is provided on each side of each top warp yarn.

14. The papermaker's fabric of claim 1, wherein the top warp yarns, the top weft yarns, and the stitching warp yarn pairs are woven together to provide a plain weave pattern in the top fabric layer.

15. The papermaker's fabric of claim 1, wherein each bottom warp yarn passes below exactly two non-adjacent bottom weft yarns in each repeat of the fabric.

16. The papermaker's fabric of claim 1, wherein the diameter of the top warp yarns is in a range between about 0.10 and 0.22 mm, wherein the diameter of the stitching warp yarns is in a range between about 0.10 and 0.22 mm, wherein the diameter of the bottom warp yarns is in a range between about 0.14 and 0.27 mm, and wherein the diameter of the bottom warp yarns is greater than the diameter of the top warn yarns and is greater than the diameter of the stitching warp yarns.

17. A warp-stitched triple layer papermaker's fabric having a top fabric layer that has a papermaking surface and a bottom fabric layer that has a machine side surface comprising:

a set of top warp yarns woven from a first warp beam that weave exclusively in the top fabric layer;

a set of top weft yarns interwoven with the top warp yarns;

a set of bottom warp yarns woven from a second warp beam that weave exclusively in the bottom fabric layer;

a set of bottom weft yarns interwoven with the bottom warp yarns;

a set of stitching warp yarns woven from a third warp beam that interweave with at least some of the top weft yarns and with at least some of the bottom weft yarns to bind the top fabric layer and the bottom fabric layer together;

wherein the stitching warp yarns are woven as stitching warp yarn pairs such that at locations in the fabric where the first of the two stitching warp yarns in the stitching warp yarn pair weaves in the top fabric layer, the second of the two stitching warp yarns in the stitching warp yarn pair drops below the top fabric layer so that together the two stitching warp yarns in each stitching warp yarn pair complete the weave in the top fabric layer;

wherein a stitching warp yarn pair is provided adjacent each top warp; and wherein each stitching warp yarn pair is substantially stacked above a respective one of the bottom warp yarns.

18. The papermaker's fabric of claim 17, wherein a stitching warp yarn pair is provided on each side of each top warp yarn.

19. The papermaker's fabric of claim 18, wherein the top warp yarns, the top weft yarns, and the stitching warp yarn pairs are woven together to provide a plain weave pattern in the top fabric layer.

20. The papermaker's fabric of claim 17, wherein, in each repeat of the fabric, each stitching warp yarn and a respective one of the bottom warp yarns that is directly adjacent to said stitching warp yarn pass below the same bottom weft yarn.

21. The papermaker's fabric of claim 20, wherein each stitching warp yarn couples with one of the bottom warp yarns at locations where the stitching warp yarns pass below the bottom weft yarns so as to form side-by-side machine-side warp direction knuckles.

22. The papermaker's fabric of claim 17, wherein each bottom warp yarn passes below exactly two non-adjacent bottom weft yarns in each repeat of the fabric.

23. The papermaker's fabric of claim 17, wherein the yarns comprising the set of stitching warp yarns differ from the yarns comprising the set of top warp yarns in at least one of the following characteristics: size, modulus or polymer type.

24. The papermaker's fabric of claim 17, wherein at least some of the top weft yarns that the stitching warp yarns of the stitching warp yarn pairs pass over immediately before dropping down below the top fabric layer have a larger diameter than the remainder of the top weft yarns.

25. The papermaker's fabric of claim 17, wherein all of the yarns in the set of top warp yarns weave over the same top weft yarns.

26. The papermaker's fabric of claim 25, wherein the top weft yarns that the top warp yarns pass over have a smaller diameter than the remainder of the top weft yarns.

27. The papermaker's fabric of claim 25, wherein the top weft yarns that the top warp yarns pass over have a lower elastic modulus than the remainder of the top weft yarns.

28. The papermaker's fabric of claim 17, wherein the two stitching warp yarns in each pair of stitching warp yarns cross over different numbers of top weft yarns in each repeat of the fabric.

29. The papermaker's fabric of claim 17, wherein at least some of the bottom warp yarns couple with one of the stitching warp yarns at locations where the bottom warp yarn passes below a bottom weft yarn.

30. The papermaker's fabric of claim 17, wherein for each stitching warp yarn pair, the first stitching warp yarn of the stitching warp yarn pair weaves on a first side of one of the bottom warp yarns and the second stitching warp yarn of each stitching yarn pair weaves on the other side of the one of the bottom warp yarns.

31. The papermaker's fabric of claim 17, wherein the diameter of the top warp yarns is in a range between about 0.10 and 0.22 mm, wherein the diameter of the stitching warp yarns is in a range between about 0.10 and 0.22 mm, wherein the diameter of the bottom warp yarns is in a range between about 0.14 and 0.27 mm, and wherein the diameter of the bottom warp yarns is greater than the diameter of the top warn yarns and is greater than the diameter of the stitching warp yarns.

32. A warp-stitched triple layer papermaker's fabric having a top fabric layer that has a papermaking surface and a bottom fabric layer that has a machine side surface comprising:

a set of top warp yarns woven from a first warp beam that weave exclusively in the top fabric layer;

a set of top weft yarns interwoven with the top warp yarns;

a set of bottom warp yarns woven from a second warp beam that weave exclusively in the bottom fabric layer;

a set of bottom weft yarns interwoven with the bottom warp yarns;

a set of stitching warp yarns woven from a third warp beam that interweave with at least some of the top weft yarns and with at least some of the bottom weft yarns to bind the top fabric layer and the bottom fabric layer together;

wherein the stitching warp yarns are woven as stitching warp yarn pairs such that at locations in the fabric where the first of the two stitching warp yarns in the stitching warp yarn pair weaves in the top fabric layer, the second of the two stitching warp yarns in the stitching warp yarn pair drops below the top fabric layer so that together the two stitching warp yarns in each stitching warp yarn pair complete the weave in the top fabric layer;

wherein each bottom warp yarn passes below exactly two non-adjacent bottom weft yarns in each repeat of the fabric; and wherein for each stitching warp yarn pair, the first stitching warp yarn of the stitching warp yarn pair weaves on a first side of one of the bottom warp yarns and the second stitching warp yarn of each stitching yarn pair weaves on the other side of the one of the bottom warp yarns.

33. The papermaker's fabric of claim 32, wherein, in each repeat of the fabric, each stitching warp yarn and a respective one of the bottom warp yarns that is directly adjacent to said stitching warp yarn pass below the same bottom weft yarn.

34. The papermaker's fabric of claim 33, wherein each stitching warp yarn couples with one of the bottom warp yarns at locations where the stitching warp yarns pass below the bottom weft yarns so as to form side-by-side machine-side warp direction knuckles.

35. The papermaker's fabric of claim 32, wherein at least some of the bottom warp yarns couple with one of the stitching warp yarns at locations where the bottom warp yarn passes below a bottom weft yarn.

36. The papermaker's fabric of claim 32, wherein all of the yarns in the set of top warp yarns weave over the same top weft yarns.

37. The papermaker's fabric of claim 32, wherein the diameter of the top warp yarns is in a range between about 0.10 and 0.22 mm, wherein the diameter of the stitching warp yarns is in a range between about 0.10 and 0.22 mm, wherein the diameter of the bottom warp yarns is in a range between about 0.14 and 0.27 mm, and wherein the diameter of the bottom warp yarns is greater than the diameter of the top warn yarns and is greater than the diameter of the stitching warp yarns.

38. A warp-stitched triple layer papermaker's fabric having a top fabric layer that has a papermaking surface and a bottom fabric layer that has a machine side surface comprising:

a set of top warp yarns woven from a first warp beam that weave exclusively in the top fabric layer;

a set of top weft yarns interwoven with the top warp yarns;

a set of bottom warp yarns woven from a second warp beam that weave exclusively in the bottom fabric layer;

a set of bottom weft yarns interwoven with the bottom warp yarns; and a set of stitching warp yarns woven from a third warp beam that interweave with at least some of the top weft yarns and with at least some of the bottom weft yarns to bind the top fabric layer and the bottom fabric layer together, wherein at least some of the bottom warp yarns couple with one of the stitching warp yarns at locations where the bottom warp yarn passes below a bottom weft yarn.

39. The papermaker's fabric of claim 38, wherein the diameter of the top warp yarns is in a range between about 0.10 and 0.22 mm, wherein the diameter of the stitching warp yarns is in a range between about 0.10 and 0.22 mm, wherein the diameter of the bottom warp yarns is in a range between about 0.14 and 0.27 mm, and wherein the diameter of the bottom warp yarns is greater than the diameter of the top warn yarns and is greater than the diameter of the stitching warp yarns.

40. A warp-stitched triple layer papermaker's fabric having a top fabric layer that has a papermaking surface and a bottom fabric layer that has a machine side surface comprising:

a set of top warp yarns woven from a first warp beam that weave exclusively in the top fabric layer;

a set of top weft yarns interwoven with the top warp yarns;

a set of bottom warp yarns woven from a second warp beam that weave exclusively in the bottom fabric layer;

a set of bottom weft yarns interwoven with the bottom warp yarns; and a set of stitching warp yarns woven from a third warp beam that interweave with at least some of the top weft yarns and with at least some of the bottom weft yarns to bind the top fabric layer and the bottom fabric layer together;

wherein the stitching warp yarns are woven as stitching warp yarn pairs such that at locations in the fabric where the first of the two stitching warp yarns in the stitching warp yarn pair weaves in the top fabric layer, the second of the two stitching warp yarns in the stitching warp yarn pair drops below the top fabric layer so that together the two stitching warp yarns in each stitching warp yarn pair complete the weave in the top fabric layer; and wherein for each stitching warp yarn pair, the first stitching warp yarn of the stitching warp yarn pair weaves on a first side of one of the bottom warp yarns and the second stitching warp yarn of each stitching yarn pair weaves on the other side of the one of the bottom warp yarns.

41. The papermaker's fabric of claim 40, wherein the two stitching warp yarns in each pair of stitching warp yarns cross over different numbers of top weft yarns in each repeat of the fabric.

42. The papermaker's fabric of claim 40, wherein a stitching warp yarn pair is provided adjacent each top warp yarn.

43. The papermaker's fabric of claim 40, wherein, in each repeat of the fabric, each stitching warp yarn and a respective one of the bottom warp yarns that is directly adjacent to said stitching warp yarn pass below the same bottom weft yarn.

44. The papermaker's fabric of claim 40, wherein the diameter of the top warp yarns is in a range between about 0.10 and 0.22 mm, wherein the diameter of the stitching warp yarns is in a range between about 0.10 and 0.22 mm, wherein the diameter of the bottom warp yarns is in a range between about 0.14 and 0.27 mm, and wherein the diameter of the bottom warp yarns is greater than the diameter of the top warn yarns and is greater than the diameter of the stitching warp yarns.

45. A method of manufacturing a warp-stitched triple layer papermaker's fabric comprising:

providing from a first warp beam a set of top warp yarns that have a first diameter;

providing from a second warp beam a set of bottom warp yarns that have a diameter that is larger than the first diameter;

providing from a third warp beam a set of stitching warp yarns;

interweaving a set of top weft yarns with the set of top warp yarns and the set of stitching warp yarns to form a top fabric layer having a papermaking surface;

interweaving a set of bottom weft yarns with the set of bottom warp yarns and the set of stitching warp yarns to form a bottom fabric layer having a machine side surface; and wherein the stitching warp yarns are woven as stitching warp yarn pairs such that at locations in the fabric where the first of the two stitching warp yarns in the stitching warp yarn pair weaves in the top fabric layer, the second of the two stitching warp yarns in the stitching warp yarn pair drops below the top fabric layer so that together the two stitching warp yarns in each stitching warp yarn pair complete the weave in the top fabric layer; and wherein each stitching warp yarn pair is woven such that the first stitching warp yarn of the stitching warp yarn pair weaves on a first side of one of the bottom warp yarns and the second stitching warp yarn of each stitching yarn pair weaves on the other side of the one of the bottom warp yarns.

46. The method of claim 45, wherein, in each repeat of the fabric, each stitching warp yarn and a respective one of the bottom warp yarns that is directly adjacent to said stitching warp yarn pass below the same bottom weft yarn.

47. The method of claim 45, wherein the fabric is woven such that each stitching warp yarn couples with one of the bottom warp yarns at locations where the stitching warp yarns pass below the bottom weft yarns so as to form side-by-side machine-side warp direction knuckles.

48. The method of claim 45, wherein the yarns comprising the set of stitching warp yarns differ from the yarns comprising the set of top warp yarns in at least one of the following characteristics: size, modulus or polymer type.

49. The method of claim 45, wherein the two stitching warp yarns in each pair of stitching warp yarns cross over different numbers of top weft yarns in each repeat of the fabric.

50. The method of claim 45, wherein the set of top warp yarns provided from the first warp beam are 0.10 to 0.15 mm in diameter, the set of bottom warp yarns provided from the second warp beam are 0.15 to 0.21 mm in diameter, and the set of stitching warp yarns provided from the third warp beam are 0.10 to 0.13 mm in diameter.

51. The method of claim 45, wherein the set of top warp yarns provided from the first warp beam are polyester yarns, the set of bottom warp yarns provided from the second warp beam are polyester yarns that are larger in diameter than the yarns comprising the set of top warp yarns, and the set of stitching warp yarns provided from the third warp beam are nylon yarns.

* * * * *